US010961613B2

(12) United States Patent
Lee et al.

(10) Patent No.: US 10,961,613 B2
(45) Date of Patent: Mar. 30, 2021

(54) METHOD FOR CONTROLLING MICROSTRUCTURE AND TEXTURE OF TANTALUM

(71) Applicant: AGENCY FOR DEFENSE DEVELOPMENT, Daejeon (KR)

(72) Inventors: Seong Lee, Daejeon (KR); Seongho Yang, Daejeon (KR); Sungho Lee, Daejeon (KR); Hyotae Jeong, Gangneung-si (KR); Yuyeon Jo, Chuncheon-si (KR)

(73) Assignee: AGENCY FOR DEFENSE DEVELOPMENT, Daejeon (KR)

( * ) Notice: Subject to any disclaimer, the term of this patent is extended or adjusted under 35 U.S.C. 154(b) by 459 days.

(21) Appl. No.: 15/538,407

(22) PCT Filed: Apr. 23, 2015

(86) PCT No.: PCT/KR2015/004071

§ 371 (c)(1),
(2) Date: Jun. 21, 2017

(87) PCT Pub. No.: WO2016/104878

PCT Pub. Date: Jun. 30, 2016

(65) Prior Publication Data

US 2017/0342537 A1 Nov. 30, 2017

(30) Foreign Application Priority Data

Dec. 22, 2014 (KR) ..... 10-2014-0185985
Apr. 22, 2015 (KR) ..... 10-2015-0056729

(51) Int. Cl.
*C22F 1/18* (2006.01)
*B21J 5/08* (2006.01)

(52) U.S. Cl.
CPC .. *C22F 1/18* (2013.01); *B21J 5/08* (2013.01)

(58) Field of Classification Search
None
See application file for complete search history.

(56) References Cited

U.S. PATENT DOCUMENTS 8,580,053 B2 * 11/2013 Sato ..... C23C 14/3414 148/668
9,017,493 B2 * 4/2015 Hagihara ..... B21J 1/02 148/559

(Continued)

FOREIGN PATENT DOCUMENTS

JP 2007-302996 A 11/2007
JP 2013-078770 A 5/2013

(Continued)

OTHER PUBLICATIONS

Schwartz, Mel.Encyclopedia and Handbook of Materials, Parts, and Finishes (3rd Edition)—Cross Rolling.(pp. 236). Taylor & Francis. (2016). (Year: 2016).*

(Continued)

*Primary Examiner* — Keith D. Hendricks
*Assistant Examiner* — Joshua S Carpenter
(74) *Attorney, Agent, or Firm* — Scully Scott Murphy and Presser

(57) ABSTRACT

A method for controlling the microstructure and texture of tantalum is described. The method includes a first forging step for performing upset forging and come-back forging on a tantalum billet multiple times in different directions, the upset forging performed to press two surfaces of the tantalum billet in order to make the two surfaces close to each other and the come-back forging performed to restore the tantalum billet to a rectangular prism shape; and a second forging step for performing wedge forging and come-back forging on the tantalum billet multiple times in different directions, the wedge forging performed to press two edges located in a diagonal direction of the tantalum billet and (Continued)

parallel to each other in order to make the two edges close to each other, and the come-back forging performed to restore the tantalum billet to the rectangular prism shape.

23 Claims, 17 Drawing Sheets

(56) References Cited

U.S. PATENT DOCUMENTS

| | | | | |
|---|---|---|---|---|
| 2002/0112789 | A1* | 8/2002 | Jepson | C22C 27/02 148/422 |
| 2012/0267236 | A1* | 10/2012 | Nakashima | C22F 1/18 204/192.1 |

FOREIGN PATENT DOCUMENTS

| | | | |
|---|---|---|---|
| KR | 20100065887 | A | 6/2010 |
| KR | 1020110042216 | A | 4/2011 |
| KR | 20110083640 | A | 7/2011 |
| KR | 101374281 | B1 | 4/2014 |
| KR | 20150038585 | A | 4/2015 |
| KR | 20150039218 | A | 4/2015 |
| WO | WO 2012/090892 | A1 | 7/2012 |

OTHER PUBLICATIONS

Alloy Digest. "Tantalum". Engineering Alloys Digest (1972) (Year: 1972).*

Schwartz et al. Encyclopedia and Handbook of Materials, Parts, and Finishes (3rd Edition)—Tantalum and Alloys. Taylor & Francis. p. 931. (2016) (Year: 2016).*

International Search Report dated Sep. 22, 2015 issued in PCT/KR2015/004071.

English Abstract only of WO 2010051040 A1, dated May 6, 2010.

Cho, Yu Yeon et al., "Change in Microstructure and Crystal Texture according to Cross Rolling and Recrystallization of Tantalum Sheet", Abstract Book for 2014 Autumn Conference of the Korean Institute of Metal and Materials, Oct. 23, 2014, p. 237, with English Abstract.

Cho, Yu Yeon et al., "Analysis for Homogenization of Tantalum Crystal Texture and Microstructure", Journal of 4th High Energy-Military Materials Conference, Nov. 11, 2014, pp. 421-424, with English Abstract.

Jo, Yu Yeon et al., "Analysis of forging processes to obtain homogeneous initial texture and microstructure of tantalum sheet" , Abstract Book for 2014 Autumn Conference of the Korean Institute of Metal and Materials, Oct. 23, 2014, p. 237, p. 8-3.

Lee, Seong et al., "Evolution of texture and microstructure in tantalum fabricated by multi-axial forging", 2014 Fall Conference of the Korean Powder Metallurgy Institute, Nov. 13, 2014, B10.

Jeong, Hyo Tae, Thesis, "A study on Manufacturing Processes for Plane Isotropic Tantalum and Copper Plate by Control of Texture and Initial Microstructure", Dec. 31, 2014.

Yang, Seong Ho et al., "Texture Change of Tantalum by Plastic Deformation", Abstract Book for 2014 General Conference of the Korea institute of Military Science and Technology, Jun. 19, 2014, p. 164.

Jeong, Hyo Tae et al., "Evolution of texture and microstructure in pure tantalum plate fabricated by multi-axial forging", Abstract on the Academic Journal, 17th International Conference on Texture of Materials of ICOTOM, Aug. 24, 2014.

* cited by examiner

METHOD FOR CONTROLLING MICROSTRUCTURE AND TEXTURE OF TANTALUM

CROSS-REFERENCE TO RELATED APPLICATIONS

This application is the National Stage filing under 35 U.S.C. 371 of International Application No. PCT/KR2015/004071, filed on Apr. 23, 2015, which claims the benefit of earlier filing date and right of priority to Korean Application Nos. 10-2014-0185985, filed on Dec. 22, 2014, 10-2015-0056729, filed on Apr. 22, 2015, the contents of which are all hereby incorporated by reference herein in their entirety.

TECHNICAL FIELD

The present invention relates to a method for controlling a microstructure and a texture of tantalum. The present invention relates to a method for controlling a microstructure of tantalum to a uniform and micro size. The present invention relates to a method for controlling a texture of tantalum so as to orient a crystal plane desired by a user.

BACKGROUND ART

A microstructure and a texture of a metal material have a significant effect on the properties of the metal. As a method for controlling a microstructure and a texture of a metal material, a method for applying a plastic deformation to the metal material or adding a heat treatment to the metal material may be used. When the structure of the metal material is controlled by the plastic deformation and the heat treatment, the properties of the metal material may be improved.

Tantalum is a metal having a melting point of 2,996° C. and a density of 16.6 g/cm$^3$. Tantalum has mechanical properties and physical properties, such as a high quantity of electric charge, a low resistance temperature coefficient, and excellent ductility and corrosion resistance. Due to the excellent mechanical properties and physical properties, tantalum is a metal which is widely used in the whole industry ranging from electrics and electronics to not only mechanical engineering, chemical engineering, and medicine, but also the space and military sectors. In particular, among the military uses, studies on applying tantalum as a material for an explosively formed penetrator liner have been conducted. In order to improve the penetrating power of an explosively formed penetrator, it is known that it is essential to control a microstructure and a texture of tantalum.

In order to plastically deform a common, commercially available metal, methods such as rolling, extrusion, and drawing are used. However, when these methods are simply applied to tantalum unlike common, commercially available metals, a microstructure and a texture, which are very heterogeneous, are caused to be formed. In order to utilize the features and advantages of the tantalum metal, it is essential to control the microstructure and the texture, but there is a limitation in controlling the microstructure and the texture of tantalum by using the methods such as rolling, extrusion, and drawing.

DISCLOSURE OF THE INVENTION

Therefore, an object of the present invention is to provide a method for controlling a microstructure and a texture of tantalum.

An object of the present invention is to provide a method for controlling the microstructure of tantalum, such that tantalum has a crystal size of 50 μm or less.

An object of the present invention is to provide a method for controlling a crystal direction of tantalum in a random distribution, such that all the crystal planes of tantalum are almost equally oriented in a direction parallel to a plate surface of tantalum.

An object of the present invention is to provide a method for selectively controlling the texture of tantalum, such that at least one crystal plane of the {111} crystal plane, the {100} crystal plane and the {110} crystal plane is preferentially oriented in a direction parallel to a plate surface of tantalum.

To achieve these and other advantages and in accordance with the purpose of the present invention, as embodied and broadly described herein, there is provided a method for controlling a microstructure and a texture of tantalum according to an Example of the present invention, the method includes: the steps of performing cold working on a tantalum billet having a rectangular prism shape; and performing cold rolling multiple times, in which the step of performing the cold working includes: a first forging step of performing upset forging and come-back forging on the tantalum billet multiple times in different directions, the upset forging being performed to press two surfaces of the tantalum billet so as to make the two surfaces close to each other and the come-back forging being performed to restore the tantalum billet to the original shape; and a second forging step of performing wedge forging and come-back forging on the tantalum billet multiple times in different directions, the wedge forging being performed to press two corners located in a diagonal direction of the tantalum billet and parallel to each other so as to make the two corners close to each other and the come-back forging being performed to restore the tantalum billet to the original shape.

According to an example related to the present invention, the upset forging may be performed by restricting a deformation of the tantalum billet in a first direction based on first to third directions which are perpendicular to each other, and pressing a surface of the tantalum billet along the third direction in a state where a deformation rate in the second direction is set.

The upset forging may be performed in a first base mold and a first pressing mold, and the first base mold includes: deformation restricting surfaces brought into contact with surfaces of the tantalum billet facing the first direction so as to restrict the plastic deformation of the tantalum billet in the first direction; and deformation rate setting surfaces spaced apart from surfaces of the tantalum billet facing the second direction so as to set the deformation rate of the tantalum billet, and the first pressing mold may be composed so as to press the surface of the tantalum billet facing the third direction.

According to another example related to the present invention, the come-back forging of the first forging step may be performed by restricting a deformation of the tantalum billet in a first direction based on first to third directions which are perpendicular to each other, and pressing a surface of the tantalum billet along the second direction in a state where a deformation rate in the third direction is set.

The come-back forging of the first forging step may be performed in a second base mold and a second pressing mold, and the second base mold includes: deformation restricting surfaces brought into contact with surfaces of the tantalum billet facing the first direction so as to restrict the plastic deformation of the tantalum billet in the first direction; deformation rate setting surfaces spaced apart from surfaces of the tantalum billet facing the third direction so as to set the deformation rate of the tantalum billet; and a bottom surface which forms a receiving portion corresponding to the original shape of the tantalum billet together with the deformation restricting surfaces and the deformation rate setting surfaces, and the second pressing mold may be composed so as to press one surface of the tantalum billet facing the second direction.

According to another example related to the present invention, the wedge forming may be performed by restricting a deformation of the tantalum billet in one direction, and pressing, in a state where a deformation rate is set in a direction which makes two corners located in a direction diagonal to each other among four corners parallel to the one direction spaced apart from each other, the other two corners in a direction which makes the other two corners close to each other.

The wedge forging may deform two corners spaced apart from each other into each surface so as to plastically deform the tantalum billet into an octahedron.

The wedge forging may be performed in a third base mold and a third pressing mold, and the third base mold may include: deformation restricting surfaces brought into contact with surfaces of the tantalum billet facing one direction so as to restrict a plastic deformation of the tantalum billet in the one direction; a first pressing corner composed so as to support a corner of the tantalum billet; first pressing inclined surfaces formed to be inclined symmetrically at both sides of the first pressing corner so as to set a deformation rate of the tantalum billet; and height surfaces spaced apart from the tantalum billet so as to deform the tantalum billet into an octahedron, and the third pressing mold may include: a second pressing corner composed so as to press a corner located in a diagonal direction of a corner supported by the first pressing corner; and second pressing inclined surfaces formed to be inclined symmetrically at both sides of the second pressing corner so as to set a deformation rate of the tantalum billet.

An angle between the first pressing surfaces and an angle between the second pressing surfaces may be each 100° to 170°.

The come-back forging of the second forging step may be performed by restricting a deformation of the tantalum billet in the one direction, and pressing a surface formed by the wedge forging in a state where a deformation rate is set in a direction which again makes the two corners close to each other by the wedge forging far away from each other.

The come-back forging of the second step may deform two surfaces located at both sides of each of the two corners which are again far away from each other into one surface so as to plastically deform the tantalum billet into a hexahedron.

The come-back forging of the second forging step may be performed in a fourth base mold and a fourth pressing mold, and the fourth base mold includes: deformation restricting surfaces brought into contact with surfaces of the tantalum billet facing the one direction so as to restrict the plastic deformation of the tantalum billet in the one direction; deformation rate setting surfaces spaced apart from the corners pressed during the wedge forging so as to deform the tantalum billet into a hexagon; and a bottom surface which forms a receiving portion corresponding to the original shape of the tantalum billet together with the deformation restricting surfaces and the deformation rate setting surfaces, and the fourth pressing mold may be composed so as to press a surface formed by the wedge forging.

According to another example related to the present invention, in the step of performing the cold working, a stress relief heat treatment may be performed after the first forging step or the second forging step, and the stress relief heat treatment may be performed at 800° C. to 1,400° C. for 1 minute to 5 hours.

According to another example related to the present invention, in the step of performing the cold rolling multiple times, a total reduction ratio applied to the tantalum billet may be set at 50% to 99%, such that the tantalum billet has a crystal size of 50 μm or less.

According to another example related to the present invention, in the step of performing the cold rolling multiple times, after a primary cold rolling is performed so as to change the rolling direction, the tantalum billet may be rotated every time, and then a rolling may be performed.

In the step of performing the cold rolling multiple times, the rotation angles of the tantalum billet may be the same as each other every time.

In the step of performing the cold rolling multiple times, the rotation angle of the tantalum billet every time may be set within a range from 5° to 535°.

The step of performing the cold rolling multiple times may be carried out so as to reach a total reduction ratio set as a goal, when a product of a rotation angle (a°) of the tantalum billet every time and the number (r) of cold rollings performed coincides with a multiple number (N, N is a natural number) of 360(°) ($a° \times r = 360° \times N$).

According to another example related to the present invention, the method for controlling a microstructure and a texture of tantalum may further perform a recrystallization heat treatment at 800° C. to 1,400° C. for 1 minute to 5 hours after the step of performing the cold working.

The crystal size of the tantalum billet may be controlled to 100 μm or less by performing the recrystallization heat treatment, and an orientation distribution function and a development intensity of a pole intensity of the tantalum billet may be controlled so as to have a texture distribution of 3 or less.

According to another example related to the present invention, the method for controlling a microstructure and a texture of tantalum may perform a uniaxial cold forging on the tantalum billet to have a thickness decrease rate of 40% or more after the step of performing the cold working, and subsequently, may further perform a selective heat treatment at 800° C. to 1,400° C. for 1 minute to 5 hours.

According to another example related to the present invention, the method for controlling a microstructure and a texture of tantalum may further perform a recrystallization heat treatment at 800° C. to 1,400° C. for 1 minute to 5 hours after the step of performing the cold rolling.

The tantalum billet may be processed into a tantalum plate having a plate surface by performing the cold rolling, the crystal size of the tantalum plate may be controlled to 50 μm or less by performing the crystallization heat treatment, and a texture of the tantalum plate may be controlled such that at least one crystal plane of {111}, {100}, and {110} is preferentially oriented parallel to the plate surface.

According to the present invention of the aforementioned configuration, a microstructure and a texture of tantalum may be controlled.

Further, the present invention may control the microstructure of tantalum such that tantalum has a crystal size of 50 μm or less. More preferably, the crystal size of tantalum may be controlled to 25 μm.

In addition, the present invention may control the crystal direction of tantalum in a random distribution.

Furthermore, the present invention may selectively control a texture of tantalum, such that at least one of the {111} crystal plane, the {100} crystal plane, and the {110} crystal plane of tantalum is preferentially oriented in a direction parallel to a plate surface of tantalum.

MODES FOR INVENTION

Reference will now be made in detail to the preferred embodiments of the present invention, examples of which are illustrated in the accompanying drawings. It will also be apparent to those skilled in the art that various modifications and variations can be made in the present invention without departing from the spirit or scope of the invention. Thus, it is intended that the present invention cover modifications and variations of this invention provided they come within the scope of the appended claims and their equivalents.

Description will now be given in detail of a drain device and a refrigerator having the same according to an embodiment, with reference to the accompanying drawings.

Hereinafter, a method for controlling a microstructure and a texture of tantalum related to the present invention will be described in more detail with reference to the accompanying drawings. In the present specification, like reference numbers are used to designate like constituents even though they are in different Examples, and the description thereof will be substituted with the initial description. Singular expressions used in the present specification include plural expressions unless they have definitely opposite meanings in the context.

Terms including an ordinal such as a first and a second may be used to explain various constituent elements, but the constituent elements are not limited by the terms. The terms are used only to distinguish one constituent element from another constituent element.

Figure 1:
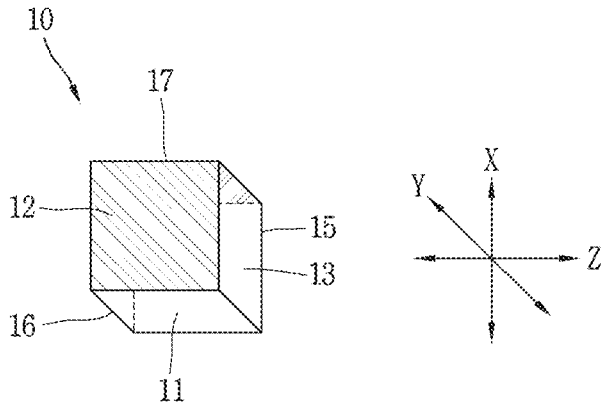
FIG. 1 is a conceptual view of a tantalum billet of which a microstructure and a texture are to be controlled.

FIG. 1 is a conceptual view of a tantalum billet 10 of which a microstructure and a texture are to be controlled.

Tantalum is prepared as a billet having a rectangular prism shape by a sintering processing such as forging. The rectangular prism means a prism of which the bases are rectangles. A rectangle, which becomes a base of the rectangular prism, includes a trapezoid, a parallelogram, a lozenge, a rectangle, and a square. Depending on the base, the shape of the rectangular prism may vary. In the present invention, a tantalum billet 10 having a rectangular prism shape is not limited to any one shape, but the tantalum billet 10 is preferably formed into a rectangular parallelepiped or a regular hexahedron.

The tantalum billet 10 has a breadth, a length, and a height. The breadth, the length, and the height of the tantalum billet are substantially perpendicular to each other.

The tantalum billet may be described based on a first direction, a second direction, and a third direction, which are perpendicular to each other. In FIG. 1, the first direction, the second direction, and the third direction were represented by X, Y, and Z, respectively. The breadth, the length, and the height of tantalum correspond to the first direction (X), the second direction (Y), and the third direction (Z), respectively.

The tantalum billet has two surfaces 11 facing the first direction (X), two surfaces 12 facing the second direction (Y), and two surfaces 13 facing the third direction (Z). The tantalum billet has six surfaces in total, and thus may be classified into a hexahedron.

The tantalum billet has four corners 15 parallel to the first direction (X), four corners 16 parallel to the second direction (Y), and four corners 17 parallel to the third direction (Z). The corners 15 in the first direction (X) are substantially parallel to each other, the corners 16 in the second direction (Y) are also substantially parallel to each other, and the corners 17 in the third direction (Z) are also substantially parallel to each other. The tantalum billet has twelve corners in total.

Figure 2:
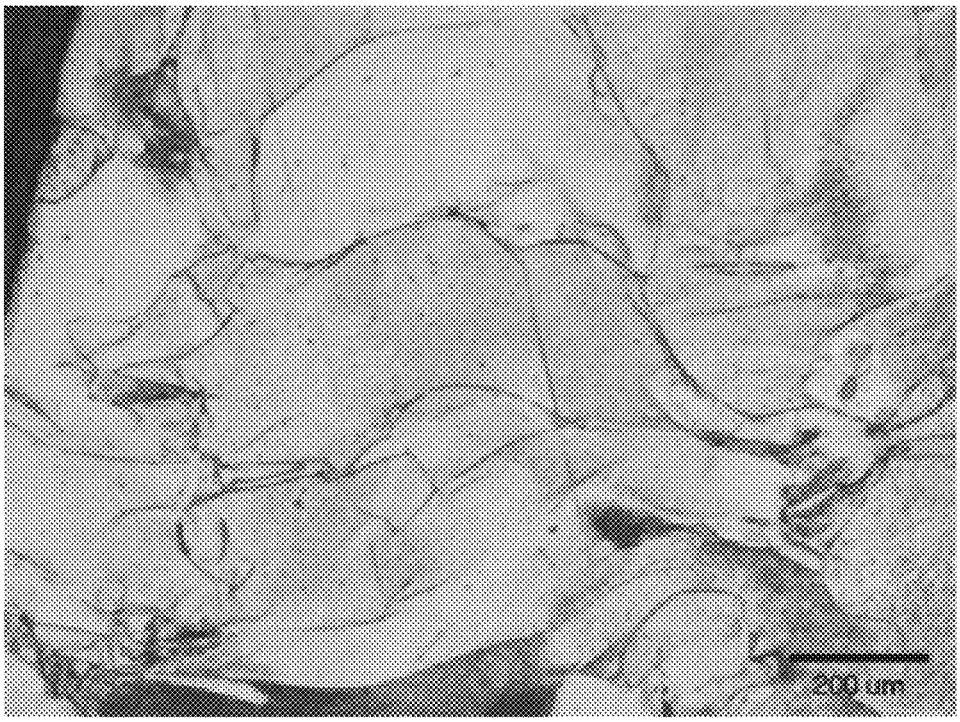
FIG. 2 is a microstructure photograph of the tantalum billet before controlling the microstructure and the texture.

FIG. 2 is a microstructure photograph of the tantalum billet before controlling the microstructure and the texture.

Before controlling the microstructure and the texture, the tantalum billet has a coarse crystal size. Referring to FIG. 2, the scale of the microstructure photograph is marked with 200 μm. Before controlling the microstructure and the texture, the tantalum billet has a crystal size more than 200 μm.

The microstructure of tantalum affects the quality of tantalum. For example, the penetrating power of an explosively formed penetrator may vary depending on the microstructure of tantalum, which constitutes a liner. The coarse crystal size of tantalum degrades the penetrating power of an explosively formed penetrator.

The crystal size of tantalum to be obtained in the present invention is 50 μm or less. More preferably, the crystal size of tantalum to be obtained in the present invention is 25 μm or less.

Figure 3:
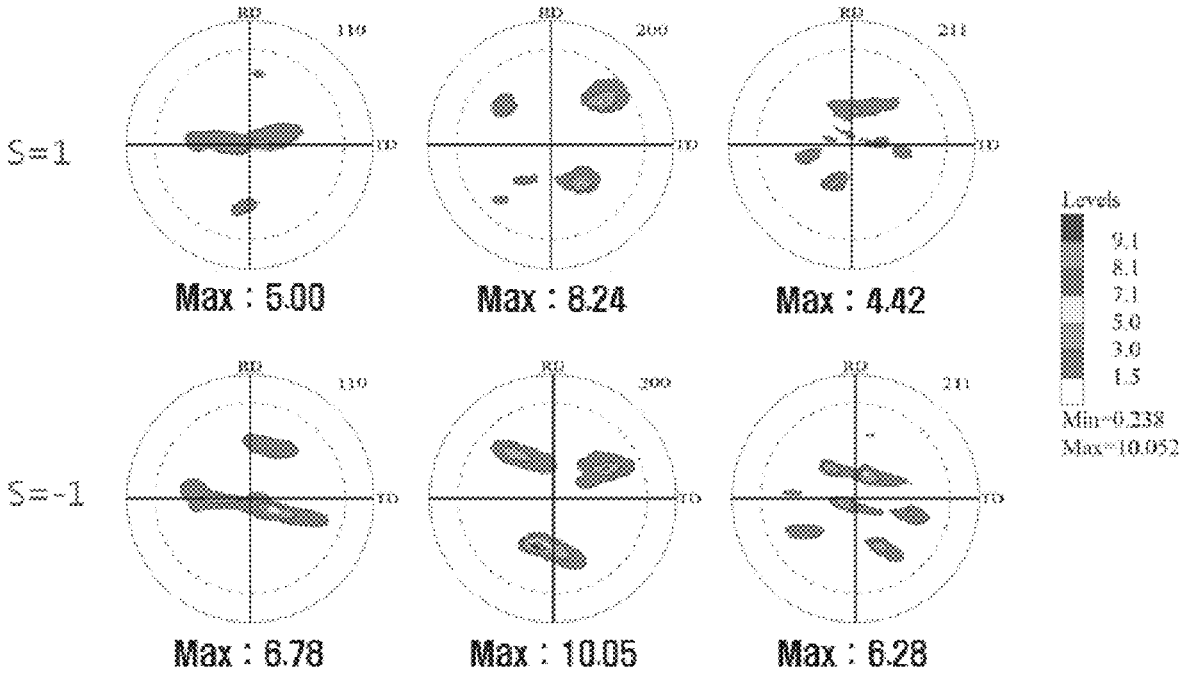
FIG. 3 is a pole figure illustrating the texture of the tantalum billet before controlling the microstructure and the texture.

FIG. 3 is a pole figure illustrating the texture of the tantalum billet before controlling the microstructure and the texture.

S represents a position in which the pole figure is measured in the tantalum billet. The center of the tantalum may be marked with S=0. S=1 represents the uppermost portion of the tantalum billet, and S=−1 represents the lowermost portion of the tantalum billet.

The number of levels marked at the right side of the pole figure is a pole intensity value showing the degree to which the texture is oriented. A pole intensity value of 1 means that the texture has a random structure which has not been developed, and a high pole intensity value means that the texture has been developed.

The figures of 110, 200, and 211 marked on the upper right side of each pole figure mean the crystal planes of a tantalum billet, and represent the pole figures of the {110} crystal plane, the {200} crystal plane, and the {211} crystal plane, respectively.

Referring to FIG. 3, it can be confirmed that the crystallographic orientation developed on the uppermost surface (S=1) and the crystallographic orientation developed on the lowermost surface (S=−1) of the tantalum billet are different from each other depending on the position of the tantalum billet, and are very strongly developing. From the confirmation, it can be seen that in the tantalum billet before controlling the microstructure and the texture, the crystal plane in a specific direction has been developed at each position. Further, it can be seen that the tantalum billet has a heterogeneous texture.

The texture of tantalum affects the quality of tantalum. For example, the penetrating power of an explosively formed penetrator may vary depending on the texture of tantalum, which constitutes a liner. A heterogeneous texture of tantalum degrades the penetrating power of the explosively formed penetrator. Further, the flight stability of an explosively formed penetrator may vary depending on the texture of tantalum, which constitutes a liner. A heterogeneous texture of tantalum degrades the flight stability of the explosively formed penetrator.

The present invention makes the coarse crystal size fine by controlling the microstructure and the texture of tantalum, and is composed so as to make the heterogeneous texture homogeneous.

Figure 4:
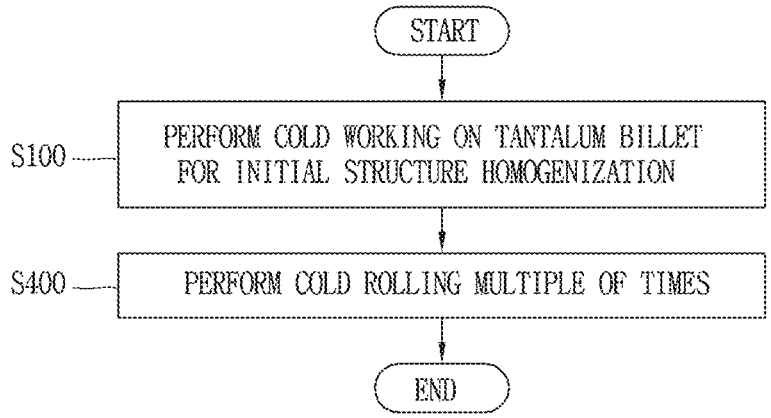
FIG. 4 is a flowchart of a method for controlling a microstructure and a texture of tantalum related to an example of the present invention.

FIG. 4 is a flowchart of a method for controlling a microstructure and a texture of tantalum related to an example of the present invention.

The method for controlling a microstructure and a texture of tantalum is composed largely of two steps. The first step is a step (S100) of performing cold working on a tantalum billet. The second step is a step (S400) of performing cold rolling on the tantalum billet multiple times.

The step (S100) of performing cold working on the tantalum billet is for homogenizing an initial structure of tantalum. The initial structure indicates a state before the microstructure and the texture are controlled. As confirmed previously in FIGS. 2 and 3, tantalum before controlling the microstructure and the texture has a coarse crystal size and a heterogeneous texture. In order to control the microstructure and the texture of tantalum, the initial structure first needs to be homogenized.

Tantalum is prepared as a billet having a rectangular prism shape as described in FIG. 1. In the step (S100) of performing cold working on a tantalum billet, plastic working is performed on the tantalum billet having a rectangular prism shape. The cold means that a process is carried out at room temperature. Since a specific method for performing cold working on a tantalum billet prepared as a rectangular prism shape is described in FIGS. 5 to 7, a specific method of the step (S100) of performing cold working will be described below with reference to FIGS. 5 to 7.

When cold working is performed on the tantalum billet, the initial structure of tantalum may be homogenized. The initial structure is homogenized, and then cold rolling is performed on the tantalum billet multiple times (S400).

The rolling means that a tantalum billet is processed into a plate shape by allowing the tantalum billet to pass between two rotating rolls. The cold rolling may be performed while the rolling direction of the cold rolling is constantly set. In contrast, the cold rolling may be performed while changing the rolling direction.

For the cold rolling in the case of changing the rolling direction, after the primary rolling, the tantalum billet is rotated before performing the cold rolling every time, and then the next rolling may be performed. The rotating direction of the tantalum billet is set in a clockwise direction or a counterclockwise direction. The tantalum billet is rotated only in a rotating direction set every time.

The rotation angles of the tantalum billet are set equally to each other every time. For example, the rotation angle of the tantalum angle every time may be set within a range from 5° to 355°. The number of cold rollings performed on the tantalum billet is determined according to (1) the rotation angle of the tantalum billet every time and (2) a total reduction ratio set as a goal in the cold rolling.

For explanation, the rotation angle of the tantalum billet every time is defined as a(°) and the number of cold rollings performed is defined as r. The cold rolling is performed on the tantalum billet so as to reach a total reduction ratio set as a target when a value of a°×r coincides with a multiple number (N, N is a natural number) of 360(°) (a°×r=360°×N).

For another example, when the rotation angle of the tantalum billet every time is set at 90°, the number (r) of cold rollings performed, which coincides with the multiple number (N) of 360(°), may be determined as a multiple number (4, 8, 12 . . . ) of 4. Accordingly, in this case, the step of performing the cold rolling may be carried out so as to reach a total reduction ratio set as a goal when rolling is performed four times (or eight times, twelve times . . . ) while rotating the tantalum billet at 90° every time. For example, the step of performing the cold rolling may be carried out so as to reach a total reduction ratio by performing a primary rolling, rotating the tantalum billet at 90° (90° based on the origin), and then performing a secondary rolling, again additionally rotating the tantalum billet at 90° (180° based on the origin), and then performing a tertiary rolling, again additionally rotating the tantalum billet at another 90° (270° based on the origin), and then performing a quaternary rolling. When the tantalum billet is returned from 270° to the origin, no rolling is performed. The reason is for performing rolling uniformly in each direction.

For still another example, when the rotation angle of the tantalum billet every time is set at 60°, the number (r) of cold rollings performed, which coincides with the multiple number (N) of 360(°), may be determined as a multiple number (6, 12, 18 . . . ) of 6. Accordingly, in this case, the step of performing the cold rolling may be carried out so as to reach a total reduction ratio set as a goal when rolling is performed six times (or twelve times, eighteen times . . . ) while rotating the tantalum billet at 60° every time.

In the step (S400) of performing cold working multiple times, a target crystal size of the tantalum billet is set at 50 μm or less. In order to reach the target crystal size, a total reduction ratio applied to the tantalum billet may be set at 50% or more, and may be set strictly at 60% to 99%. In order to adjust the crystal size of the tantalum billet to 50 μm, it is preferred that the total reduction ratio in the step of performing the cold rolling is controlled to 70% or more. It is preferred that the rotation angle of the tantalum billet every time is determined within a range from 60° to 90° in consideration of the total reduction ratio and the number (r) of cold rollings performed.

Hereinafter, the step (S100) of performing cold working will be described in more detail.

Figure 5:
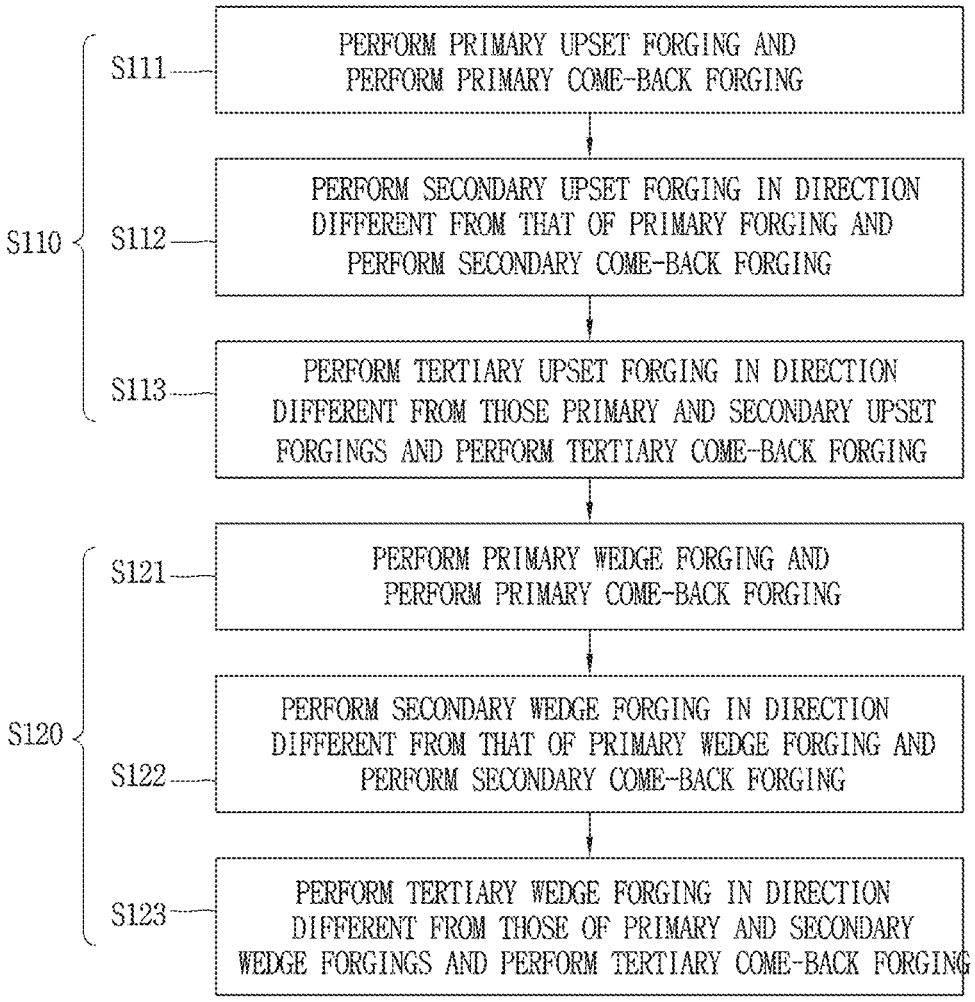
FIG. 5 is a flowchart illustrating the step of performing the cold working of FIG. 4 in more detail.
Figure 6:
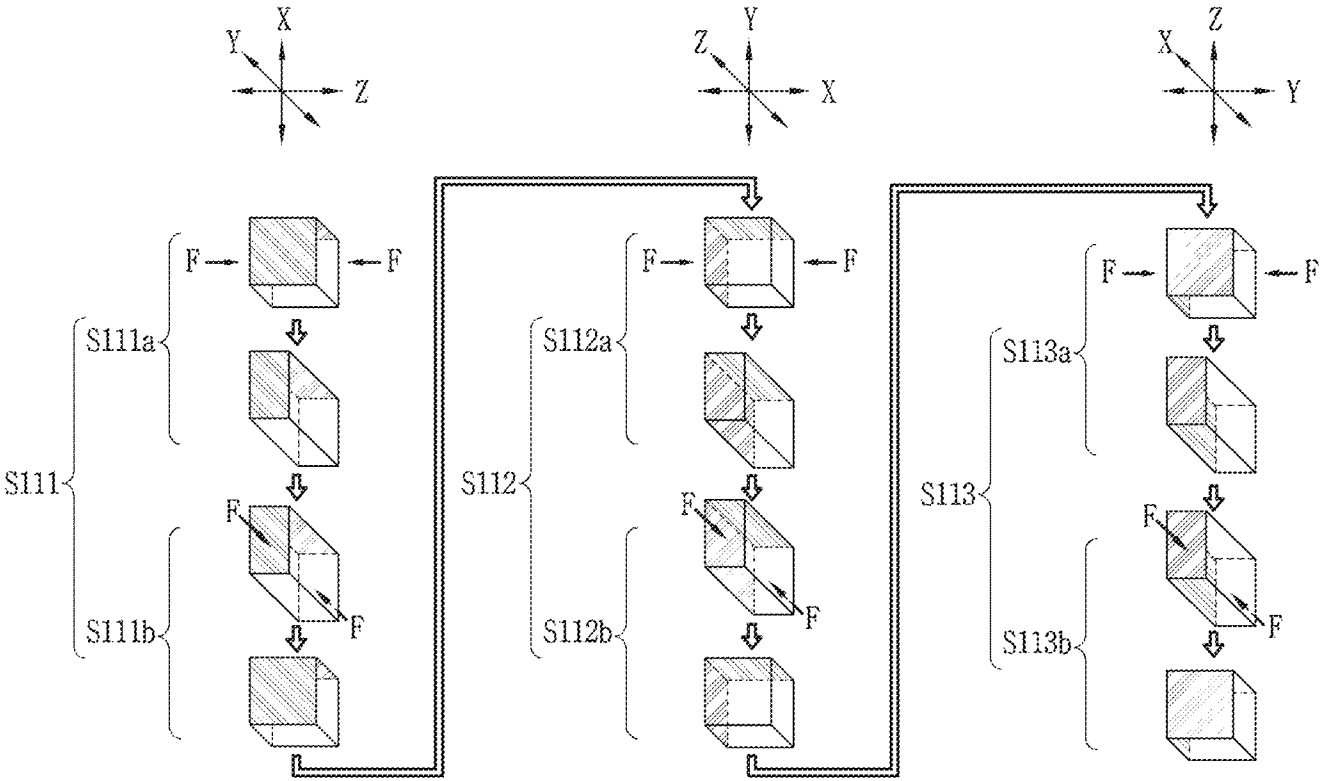
FIG. 6 is a conceptual view illustrating a procedure of a first forging step of performing upset forging and come-back forging.
Figure 7:
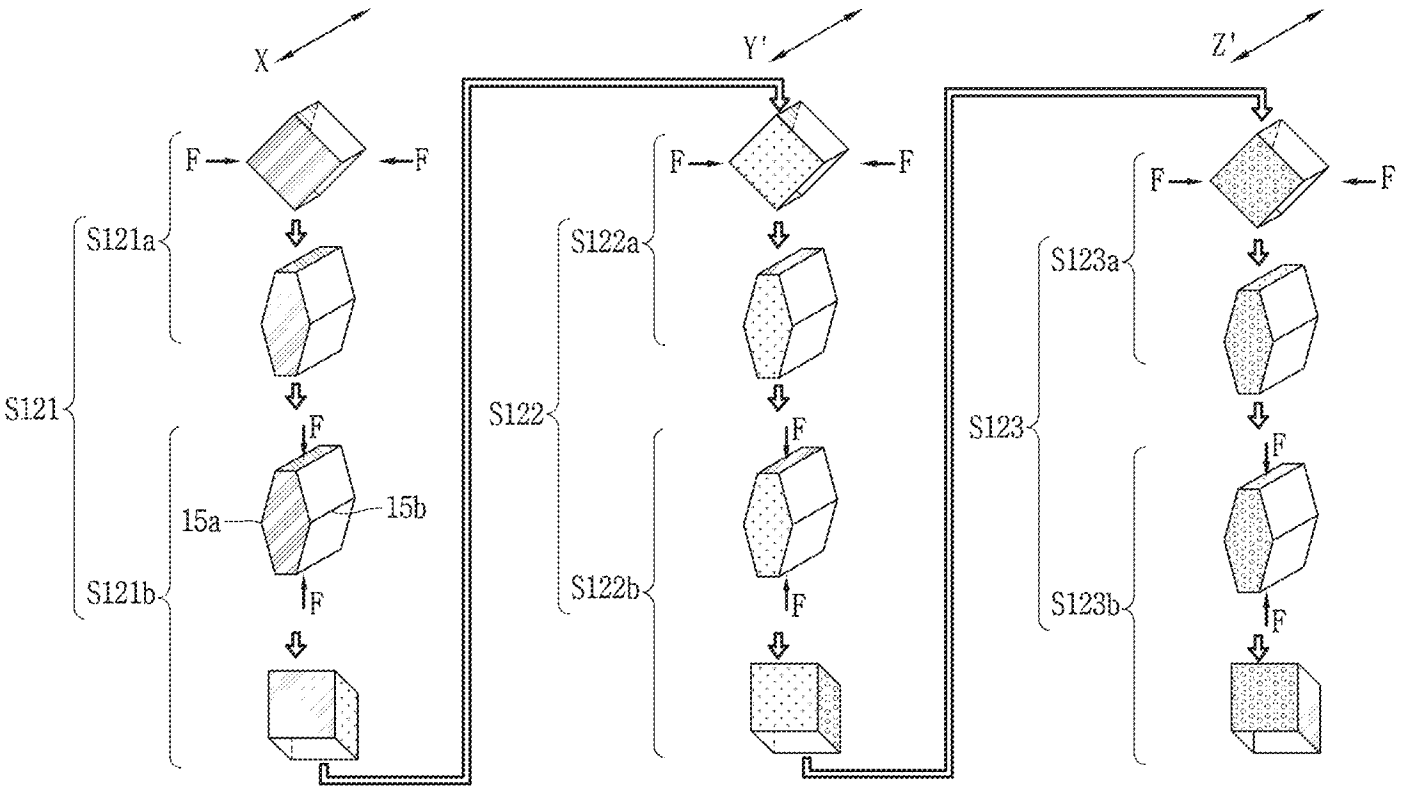
FIG. 7 is a conceptual view illustrating a procedure of a second forging step of performing wedge forging and come-back forging.

FIG. 5 is a flowchart illustrating the step (S100) of performing cold working of FIG. 4 in more detail. FIG. 6 is a conceptual view illustrating a procedure of a first forging step (S110) of performing upset forging and come-back forging. FIG. 7 is a conceptual view illustrating a procedure of a second forging step (S120) of performing wedge forging and come-back forging.

First, referring to FIG. 5, the step (S100) of performing cold working on the tantalum billet includes the first forging step (S110) and the second forging step (S120).

In the first forging step (S110), upset forging and come-back forging are performed in different directions. The different directions may be, for example, first to third directions which are perpendicular to each other. Specifically, the first forging step (S110) includes a step (S111) of performing a primary upset forging in a first direction and performing a primary come-back forging, a step (S112) of performing a secondary upset forging in a second direction and performing a second come-back forging, and a step (S113) of performing a tertiary upset forging in a third direction and performing a tertiary come-back forging.

The upset forging means a forging which presses two surfaces of a tantalum billet so as to be close to each other. The come-back forging means a forging which restores the tantalum billet to a shape prior to the upset forging. The sequence of the direction in which the upset forging and the come-back forging are performed is arbitrary.

In the second forging step (S120), wedge forging and come-back forging are performed on the tantalum billet in different directions. Specifically, the second forging step (S120) includes a step (S121) of performing a primary wedge forging by pressing corners in any one direction and performing a primary come-back forging, a step (S122) of performing a wedge forging by pressing corners in a direction different from that of the primary wedge forging and performing a secondary come-back forging, and a step (S123) of performing wedge forging by pressing corners in a direction different from those of the primary and secondary wedge forgings and performing come-back forging.

The wedge forging means a forging which presses two corners of a tantalum billet, which are parallel to each other, so as to be close to each other. The come-back forging means a forging which restores the tantalum billet to a shape prior to the wedge forging. The sequence of the direction in which the wedge forging and the come-back forging are performed is arbitrary.

The first forging step (S110) and the second forging step (S120) may be repeated until the tantalum billet reaches a target total deformation rate. The total deformation rate means a total sum of deformation rates applied to a deformation rate of the tantalum billet when both the first forging step (S110) and the second forging step (S120) are completed.

In each of the forging steps (S110)(S120), the deformation rate of the tantalum billet is determined in consideration of the elongation of tantalum. In the case of tantalum having a high elongation of 40% to 55%, a deformation rate in a pressed deformation axis direction may be set at 10% to 70%, and may be strictly set at preferably 20% to 50%. The deformation rate in a pressed deformation axis direction means a deformation rate applied to the tantalum billet through forging performed one time. When the deformation rate in a pressed deformation axis direction is less than 20%, the deformation may not be sufficiently carried out to the inside of the tantalum billet. Conversely, when the deformation rate in a pressed deformation axis direction is more than 50%, a breakage may occur to the tantalum billet. It is preferred that the total deformation rate is set as high as possible as long as the breakage does not occur.

After the first forging step (S110) or the second forging step (S120), a stress relief heat treatment may be performed. The stress relief heat treatment is for preventing occurrence of cracks or tears in consideration of the elongation of the tantalum billet.

When the first forging step (S110) and the second forging step (S120) are repeatedly performed, the stress relief heat treatment may also performed several times. For example, it is possible to repeat a procedure of performing the stress relief heat treatment after the first forging step (S110) and performing the stress relief heat treatment after the second forging step (S120). Alternatively, it is also possible to repeat a procedure of performing the stress relief heat treatment only after the second forging step (S120) without performing the stress relief heat treatment after the first forging step (S110).

FIG. 6 illustrates the procedure of the first forging step (S110) of performing upset forging and come-back forging.

The upset forging (S111*a*, S112*a*, and S113*a*) is performed by restricting a deformation of the tantalum billet in any one direction (for example, a first direction) of first to third directions (X to Z) which are perpendicular to each other and pressing the surface of the tantalum billet along the other direction (for example, a third direction) in a state where the deformation rate (or the deformation amount) of the tantalum billet is set in another direction (for example, a second direction). It is possible to arbitrarily select the sequence of the direction in which the deformation is restricted, the direction in which the deformation rate (or the deformation amount) is set, and the direction in which the tantalum billet is pressed.

Referring to FIG. 6, the primary upset forging (S111*a*) is performed by restricting the deformation of the tantalum billet in the first direction (X) and pressing (F) the surface of the tantalum billet along the third direction (Z) in a state where the deformation rate (or the deformation amount) is set in the second direction (Y). The tantalum billet has no change in the first direction, is protruded by a deformation rate (or a deformation amount) set in advance in the second direction, and is compressed in the third direction by the primary upset forging (S111*a*).

The tantalum billet, which was a regular hexahedron, is plastically deformed into a rectangular parallelepiped by the primary upset forging (S111*a*). When the primary upset forging (S111*a*) is completed, a primary come-back forging (S111*b*) is subsequently performed.

The come-back forging (S111*b*, S112*b*, and S113*b*) is performed by restricting a deformation of the tantalum billet in any one direction (for example, a first direction) of first to third directions (X to Z) which are perpendicular to each other and pressing the surface of the tantalum billet along the other direction (for example, a third direction) in a state where the deformation rate (or the deformation amount) of the tantalum billet is set in another direction (for example, a second direction).

In the come-back forging (S111*b*, S112*b*, and S113*b*), the deformation rate (or the deformation amount) is set as a value in which the tantalum billet is restored to a shape which is the same as the original shape. The direction in which the tantalum billet is pressed is a direction in which the tantalum billet is protruded in the upset forging step. For example, in the upset forging steps (S111*a*, S112*a*, and S113*a*), when the tantalum billet is protruded in the third direction, the surface of the tantalum billet facing the third direction is pressed in the come-back forging (S111*b*, S112*b*, and S113*b*).

Referring to FIG. 6, the first come-back forging (S111*b*) is performed by restricting the deformation of the tantalum billet in the first direction (X) and pressing (F) the surface of the tantalum billet along the second direction (Y) in a state where the deformation rate (or the deformation amount) is set in the third direction (Z). The tantalum billet has no change in the first direction (X), is protruded by a deformation rate (or a deformation amount) set in advance in the third direction (Z), and is compressed in the second direction (Y).

In FIG. 6, the first come-back forging (S111*b*) is performed in a state where the tantalum billet completely subjected to the primary upset forging (S111*a*) is rotated at 90°. Accordingly, the surface to be pressed in the primary come-back forging (S111*b*) corresponds to a surface which was protruded in the primary upset forging (S111*a*).

In the come-back forging, the deformation rate (or the deformation amount) is set as a value in which the tantalum billet is restored to a shape which is the same as the original shape. The tantalum billet is restored to the original shape by the primary come-back forging (S111*b*). The original shape means a shape prior to the primary upset forging (S111*a*).

When the primary upset forging (S111*a*) and the primary come-back forging (S111*b*) are completed, a secondary upset forging (S112*a*) and a secondary come-back forging (S112*b*) are subsequently performed. Moreover, when the secondary upset forging (S112*a*) and the secondary come-back forging (S112*b*) are completed, a tertiary upset forging (S113*a*) and a tertiary come-back forging (S113*b*) are subsequently performed.

The secondary upset forging (S112*a*) and the tertiary upset forging (S113*a*) are performed substantially in the same manner as in the primary upset forging (S111*a*), except that the directions of the secondary upset forging (S112*a*) and the tertiary upset forging (S113*a*) are different from that of the primary upset forging (S111*a*). Likewise, the secondary come-back forging (S112*b*) and the tertiary come-back forging (S113*b*) are performed substantially in the same manner as in the primary come-back forging (S111*b*), except that the directions of the secondary come-back forging (S112*b*) and the tertiary come-back forging (S113*b*) are different from that of the primary upset forging (S111*a*).

As the upset forging (S111*a*, S112*a*, and S113*a*) and the come-back forging (S111*b*, S112*b*, and S113*b*) are performed in the first to third directions, a uniform plastic deformation in a diagonal direction is usually applied to the inside of the tantalum billet.

With only the upset forging (S111*a*, S112*a*, and S113*a*) and the come-back forging (S111*b*, S112*b*, and S113*b*) in the first to third directions, the deformation is usually applied to the tantalum billet only in a diagonal direction thereof, and almost no plastic deformation is applied of the tantalum billet in a direction perpendicular to or parallel to each surface thereof. Accordingly, wedge forging and come-back forging are performed in order to add a deformation to the tantalum billet in a direction perpendicular to or parallel to each surface thereof.

FIG. 7 illustrates the procedure of the second forging step (S120) of performing wedge forging and come-back forging.

The wedge forging (S121*a*, S122*a*, and S123*a*) is performed by restricting a deformation of the tantalum billet in any one direction, and pressing, in a state where a deformation rate is set in a direction which makes two corners located in a direction diagonal to each other among four corners parallel to the direction in which the deformation is restricted spaced apart from each other, the other two corners in a direction which makes the other two corners close to each other. The two corners located in a direction diagonal to each other means two corners which are not adjacent to each other. The other two corners are also located in a direction diagonal to each other.

The tantalum billet having a rectangular prism shape has four corners which are parallel to each other. Accordingly, when the two corners located in a direction diagonal to each other are pressed, the two corners to be pressed are close to each other, and the other two corners which are not pressed are far away from each other. The wedge forging plastically deforms two corners spaced apart from each other into a surface so as to plastically deform the tantalum billet into an octahedron. Accordingly, the tantalum billet is processed from a shape of a hexahedron in which two surfaces are located at both sides of the corner to a shape of an octahedron in which two surfaces are located at both sides of the surface.

Two surfaces are located at both sides of each corner pressed in a direction which is close to each other. Before the wedge forging is performed, an angle in which two surfaces meet is substantially 90°. The angle is changed into an obtuse angle by the wedge forging. The range of the obtuse angle changed by the wedge forging may be set at about 100° to about 170°. When the obtuse angle is less than 100°, a deformation rate applied to the tantalum billet is extremely small, and when the obtuse angle is more than 170°, the corner is pressed down in the same manner as in the case where the surface is pressed down, and as a result, it is difficult to substantially perform a wedge forging.

The primary wedge forging (S121*a*) may be performed by restricting a deformation of the tantalum billet in a first direction (X), and pressing, in a state where a deformation rate is set in a direction which makes two corners located in a direction diagonal to each other among four corners parallel to the first direction (X) spaced apart from each other, the other two corners in a direction which makes the other two corners close to each other. When the primary wedge forging (S121*a*) is performed as described above, the tantalum billet has no change in the first direction (X), but two corners to be pressed are close to each other, and two corners to be far away from each other are each plastically deformed into a surface. As two surfaces are additionally formed on the tantalum billet having a hexahedron shape, the tantalum billet is deformed into an octahedron shape.

The come-back forging (S121*b*, S122*b*, and S123*b*) is performed by restricting the deformation of the tantalum billet in a direction which is the same as a direction in which the deformation is restricted in the wedge forging (S121*a*, S122*a*, and S123*a*), and pressing the two surfaces formed by the wedge forging (S121*a*, S122*a*, and S123*a*) in a state where a deformation rate (or a deformation amount) is set in a direction which again makes the two corners close to each other by the wedge forging (S121*a*, S122*a*, and S123*a*) far away from each other. The deformation rate (or the deformation amount) is set as a value in which the tantalum billet is restored to a shape which is the same as the original shape prior to the wedge forging.

The come-back forging (S121*b*, S122*b*, and S123*b*) plastically deforms two surfaces located at both sides of each of the corners far away from each other into one surface while making the two surfaces close to each other by the wedge forging (S121*a*, S122*a*, and S123*a*) spaced apart from each other in a direction which again makes the two surfaces far away from each other. Accordingly, the come-back forging (S121*b*, S122*b*, and S123*b*) plastically deforms the tantalum billet from an octahedron to a hexahedron.

For example, in the primary come-back forging (S121*b*) in FIG. 7, the two corners far away from each other are a corner 15*a* located at the uppermost portion of the octahedron and a corner 15*b* located at the lowermost portion of the octahedron. For explanation, the corner 15*a* located at the uppermost portion of the octahedron may be arbitrarily referred to as a first corner 15*a* and the corner 15*b* located at the lowermost portion of the octahedron may be arbitrarily referred to as a second corner 15*b*. There are two surfaced at both sides of the first corner 15*a*, and there are also two surfaces at both sides of the second corner 15*b*. By the first come-back forging (S121*b*), the two surfaces located at both sides of the first corner 15*a* are deformed into one surface, and the two surfaces located at both sides of the second corner 15*b* are also deformed into one surface. The tantalum billet is returned from an octahedron to a hexahedron by the first come-back forging (S121*b*).

The first come-back forging (S121*b*) is performed by restricting a deformation of the tantalum billet in a first direction (X), and pressing the two surfaces formed by the primary wedge forging (S121*a*) in a direction which makes the two surfaces close to each other in a state where a deformation rate is set in a direction which again makes the two corners close to each other by the primary wedge forging far away from each other. The tantalum billet is restored to the original shape by the primary come-back forging (S121*b*). The original shape means a shape prior to the primary wedge forging (S121*a*).

When the primary wedge forging (S121*a*) and the primary come-back forging (S121*b*) are completed, a secondary wedge forging (S122*a*) and a secondary come-back forging (S122*b*) are subsequently performed. Moreover, when the secondary wedge forging (S122*a*) and the secondary come-back forging (S122*b*) are completed, a tertiary wedge forging (S113*a*) and a tertiary come-back forging (S123*b*) are subsequently performed.

The secondary wedge forging (S122*a*) and the tertiary wedge forging (S123*a*) are performed substantially in the same manner as in the primary wedge forging (S121*a*), except that the directions of the secondary wedge forging (S122*a*) and the tertiary wedge forging (S123*a*) are different from that of the first wedge forging (S121*a*). Likewise, the secondary come-back forging (S122*b*) and the tertiary come-back forging (S123*b*) are performed substantially in the same manner as in the primary come-back forging (S121*b*), except that the directions of the secondary come-back forging (S122*b*) and the tertiary come-back forging (S123*b*) are different from that of the primary come-back forging (S121*b*).

In FIG. 7, in the secondary wedge forging (S122*a*) and the tertiary wedge forging (S123*a*), the restricted directions are defined as Y' and Z', respectively, so as to differentiate the deformations of the tantalum billet from the primary wedge forging (S121*a*). The directions are marked with Y' and Z' without being marked with Y and Z directions because the directions of the tantalum billet are deformed by the primary wedge forging (S121*a*) and the primary come-back forging (S121*b*).

As primary to tertiary wedge forgings (S121*a*, S122*a*, and S123*a*) and primary to tertiary come-back forgings (S121*b*, S122*b*, and S123*b*) are performed, a uniform plastic deformation in a diagonal direction is usually applied to the inside of the tantalum billet. Since the wedge forging (S121*a*, S122*a*, and S123*a*) and the come-back forging (S121*b*, S122*b*, and S123*b*) are repeated in different directions, a plastic deformation is uniformly applied to the tantalum billet in a direction perpendicular to or parallel to each surface of the tantalum billet while the tantalum billet maintains an initial a rectangular prism shape.

As the first forging step (S110) and the second forging step (S120) are performed, the shape of the tantalum billet is maintained as the initial rectangular prism shape. Moreover, a plastic deformation is uniformly applied to the inside of the tantalum billet in a diagonal direction or in a direction perpendicular to or parallel to the surface of the tantalum billet. Due to the plastic deformation, the microstructure and the texture of tantalum may be uniformly controlled.

Figure 8A:
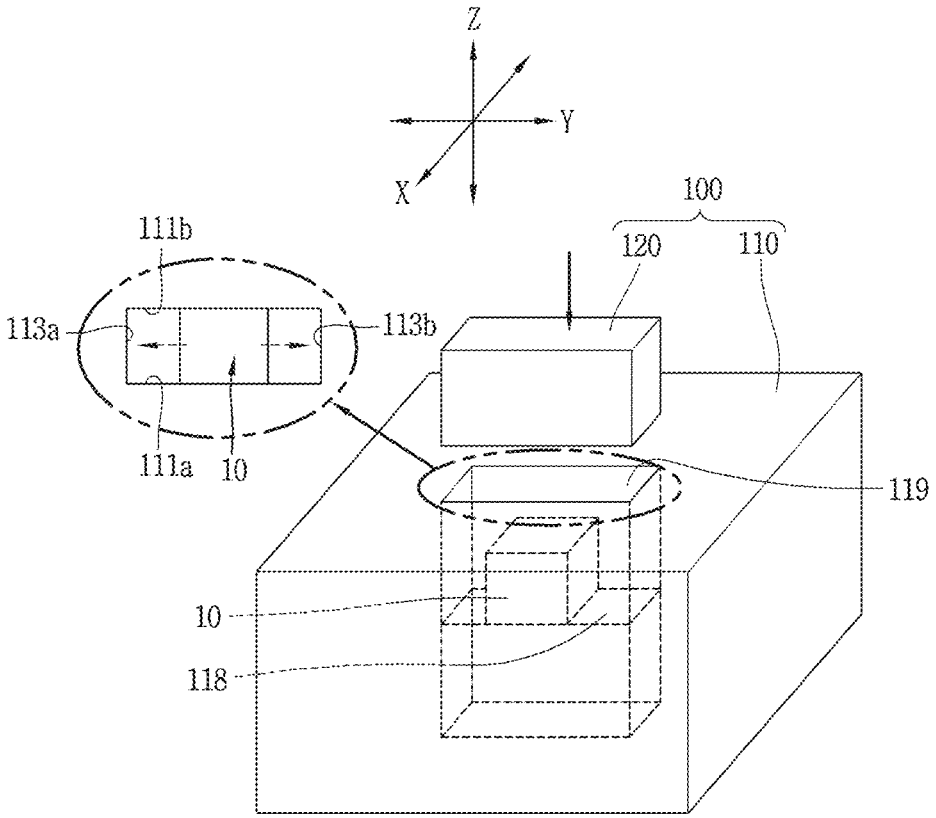
FIGS. 8*a* and 8*b* are conceptual views illustrating a first jig on which upset forging is performed and a tantalum billet which is plastically processed by the first jig.
Figure 8B:
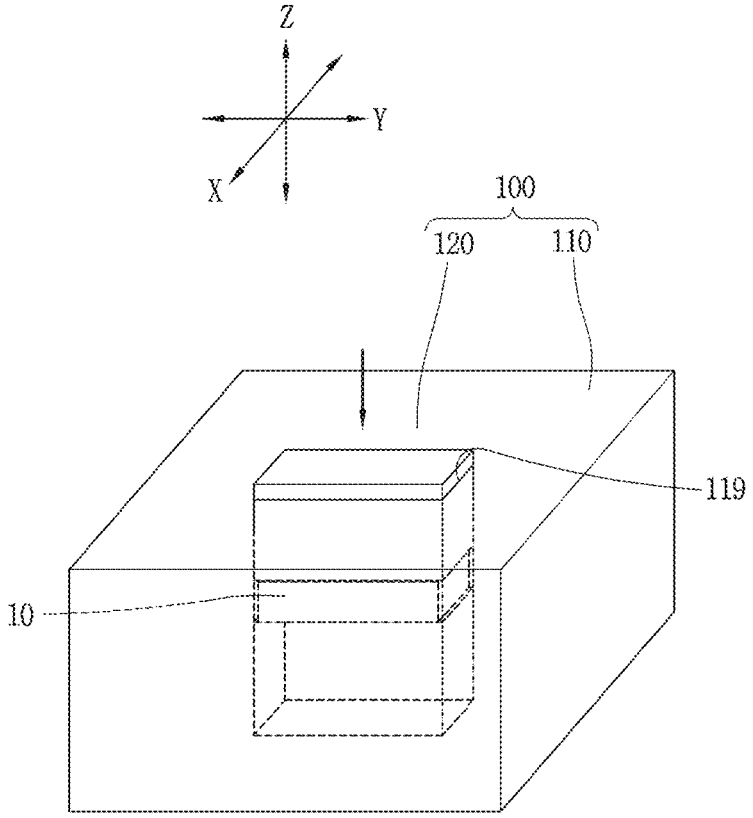

FIGS. 8*a* and 8*b* are conceptual views illustrating a first jig 100 on which upset forging is performed and a tantalum billet 10 which is plastically processed by the first jig. FIG. 8*a* illustrates a state before pressing the tantalum billet 10. FIG. 8*b* illustrates a state after pressing the tantalum billet 10.

The upset forging may be performed by using the first jig 100. The first jig 100 includes a first base mold 110 and a first pressing mold 120. For convenience of explanation, the setting is made based on first to third directions (X, Y, and Z) which are perpendicular to each other. A surface of the tantalum billet 10 in the first direction means a surface facing the first direction (X), a surface thereof in the second direction means a surface facing the second direction (Y), and a surface thereof in the third direction means a surface facing the third direction (Z). A corner of the tantalum billet 10 in the first direction means a corner parallel to the first direction (X), a corner thereof in the second direction means a corner parallel to the second direction (Y), and a corner thereof in the third direction means a corner parallel to the third direction (Z).

The first base mold 110 is composed so as to receive the tantalum billet 10. The first base mold 110 includes a bottom surface 118, deformation restricting surfaces 111*a*, 111*b*, and deformation rate setting surfaces 113*a*, 113*b*. The bottom surface 118, the deformation restricting surfaces 111*a*, 111*b*, and the deformation rate setting surfaces 113*a*, 113*b* form a space 119 (a receiving portion) which receives the tantalum billet 10. The deformation restricting surfaces 111*a*, 111 *b* and the deformation rate setting surfaces 113*a*, 113*b* substantially form a height surface of a space which receives the tantalum billet 10. The tantalum billet 10 is received in a space 119 (a receiving portion) formed by the bottom surface 118, the deformation restricting surfaces 111*a*, 111 *b*, and the deformation rate setting surfaces 113*a*, 113*b*.

The bottom surface 118 supports the tantalum billet 10 which is received in the first base mold 110. An area of the bottom surface 118 may be determined by the deformation restricting surfaces 111*a*, 111*b* and the deformation rate setting surfaces 113*a*, 113*b*. When the tantalum billet 10 is pressed by the first pressing mold 120, the bottom surface 118 presses the tantalum billet 10 at a side opposite to the first pressing mold 120 based on the tantalum billet 10.

The deformation restricting surfaces 111*a*, 111 *b* are brought into contact with surfaces of the tantalum billet 10 in the first direction (X) so as to restrict a plastic deformation of the tantalum billet 10 in the first direction (X). The tantalum billet 10 having a rectangular prism shape has two surfaces in the first direction. In this regard, the first base mold 110 also has two deformation restricting surfaces 111*a*, 111*b*. The deformation restricting surfaces 111*a*, 111 *b* are located at a side opposite to each other along the first direction (X) based on the tantalum billet 10 which is received in the first base mold 110.

The deformation restricting surfaces 111*a*, a111*b* are brought into contact with surfaces of the tantalum billet 10 in the first direction (X). Accordingly, even though external force is applied to the tantalum billet 10, the deformation restricting surfaces 111*a*, 111*b* may restrict a plastic deformation of the tantalum billet 10 in the first direction (X).

The deformation restricting surfaces 113*a*, 113*b* are spaced apart from surfaces of the tantalum billet 10 in the second direction so as to set a deformation rate of the tantalum billet 10 in the second direction (Y). The tantalum billet 10 having a rectangular prism shape has two surfaces in the second direction. In this regard, the first base mold 110 also has two deformation rate setting surfaces 113*a*, 113*b*. The deformation rate setting surfaces 113*a*, 113*b* are located at a side opposite to each other along the second direction (Y) based on the tantalum billet 10 which is received in the first base mold 110.

The deformation restricting surfaces 113*a*, 113*b* are spaced apart from the surfaces of the tantalum billet 10 in the second direction. Accordingly, when external force is applied to the tantalum billet 10, the tantalum billet 10 may be plastically deformed in the second direction (Y). When external force is sufficiently applied, the plastic deformation of the tantalum billet 10 in the second direction (Y) is carried out until the tantalum billet 10 is brought into contact with the deformation rate setting surfaces 113*a*, 113*b*, and as a result, the deformation rate setting surfaces 113*a*, 113*b* may set the deformation rate (or the deformation amount) of the tantalum billet 10. The deformation rate setting surfaces 113*a*, 113*b* may also be referred to as deformation amount setting surfaces.

The deformation rate (or the deformation amount) of the tantalum billet 10 may be determined according to the distance between the tantalum billet 10 which is received in the first base mold 110 and the deformation rate setting surfaces 113*a*, 113*b*. If the deformation rate of the tantalum billet 10 is intended to be set at a relatively small value, the deformation rate setting surfaces 113*a*, 113*b* need to be disposed relatively close to the tantalum billet 10. If the deformation rate of the tantalum billet 10 is intended to be set at a relatively large value, the deformation rate setting surfaces 113*a*, 113*b* need to be disposed relatively far away from the tantalum billet 10.

The first pressing mold 120 is composed so as to press the surface of the tantalum billet 10 in the third direction. When the first pressing mold 120 presses one of the two surfaces of the tantalum billet 10 in the third direction, the bottom surface 118 of the first base mold 110 also presses the other surface of the tantalum billet 10 in the third direction by the action-reaction law.

The upset forging is performed by disposing the tantalum billet 10 in the first base mold 110 and pressing the tantalum billet 10 by means of the first pressing mold 120. By performing the upset forging, the tantalum billet 10 has no change in the first direction (X), is protruded in the second direction (Y), and is compressed in the third direction (Z).

The upset forgings performed on the tantalum billet 10 in different directions may be performed by varying the directions in which the tantalum billet 10 is disposed in the first base mold 110.

Figure 9A:
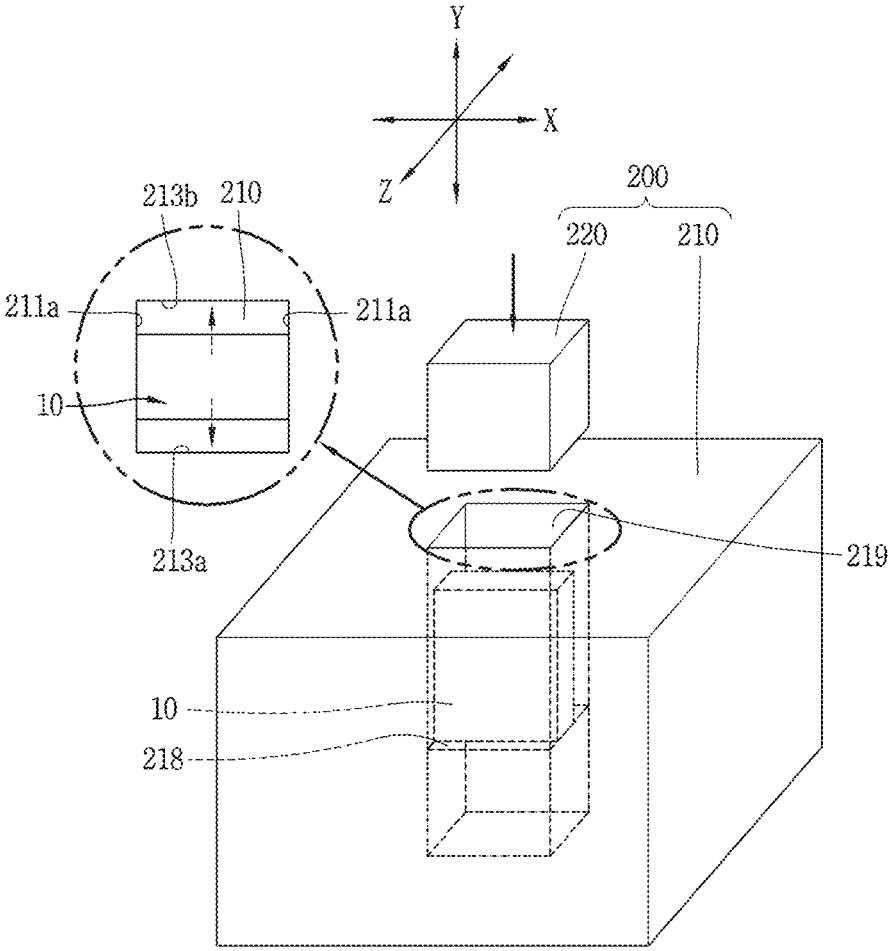
FIGS. 9*a* and 9*b* are conceptual views illustrating a second jig on which come-back forging is performed after the upset forging and a tantalum billet which is restored to the original shape by the second jig.
Figure 9B:
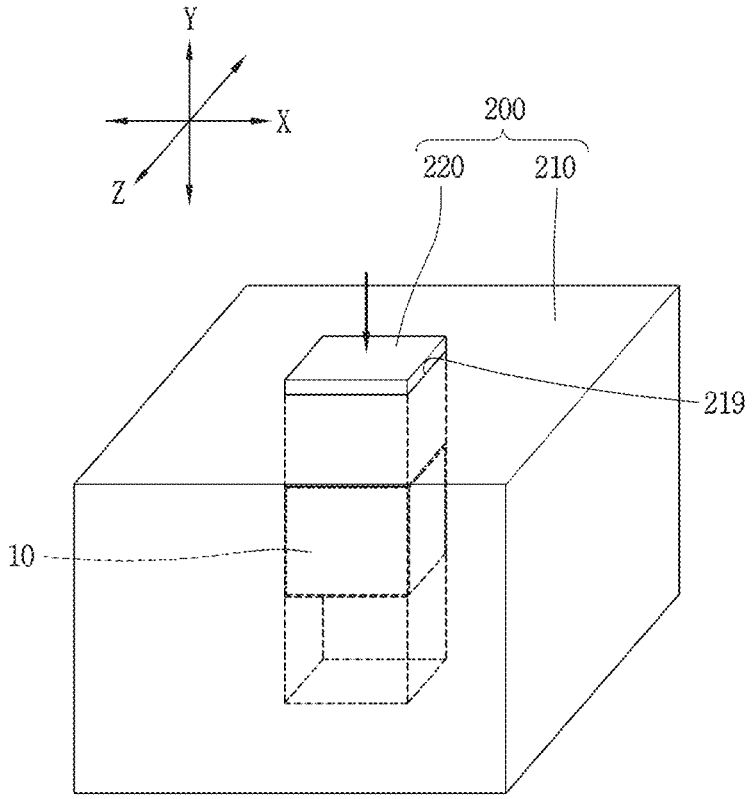

FIGS. 9*a* and 9*b* are conceptual views illustrating a second jig 200 on which come-back forging is performed after the upset forging and a tantalum billet 10 which is restored to the original shape by the second jig 200. FIG. 9*a* illustrates a state before pressing the tantalum billet 10. FIG. 9*b* illustrates a state after pressing the tantalum billet 10.

The come-back forging after the upset forging may be performed by using the second jig 200. The second jig 200 includes a second base mold 210 and a second pressing mold 220. For convenience of explanation, the setting is made based on first to third directions (X, Y, and Z) which are perpendicular to each other. A surface of the tantalum billet 10 in the first direction means a surface facing the first direction (X), a surface thereof in the second direction means a surface facing the second direction (Y), and a surface thereof in the third direction means a surface facing the third direction (Z). A corner of the tantalum billet 10 in the first direction means a corner parallel to the first direction (X), a corner thereof in the second direction means a corner parallel to the second direction (Y), and a corner thereof in the third direction (Z) means a corner parallel to the third direction.

The second base mold 210 includes a receiving portion 219 formed so as to receive the tantalum billet 10. The receiving portion 219 has a shape corresponding to the original shape of the tantalum billet 10. The original shape means a shape before the upset forging is performed on the tantalum billet 10.

The second base mold 210 includes a bottom surface 218, deformation restricting surfaces 211*a*, 211*b*, and deformation rate setting surfaces 213*a*, 213*b*. The bottom surface 218, the deformation restricting surfaces 211*a*, 211*b*, and the deformation rate setting surfaces 213*a*, 213*b* form a receiving portion 219 which receives the tantalum billet 10. The shape of the receiving portion 219 corresponds to the original shape of the tantalum billet 10. The original shape means a shape before the upset forging is performed on the tantalum billet 10. The deformation restricting surfaces 211*a*, 211*b* and the deformation rate setting surfaces 213*a*, 213*b* substantially form a height surface of the receiving portion 219. The tantalum billet 10 is received in the receiving portion 219 formed by the bottom surface 218, the deformation restricting surfaces 211*a*, 211*b*, and the deformation rate setting surfaces 213*a*, 213*b*.

The bottom surface 218 supports the tantalum billet 10 which is received in the second base mold 210. An area of the bottom surface 218 may be determined by the deformation restricting surfaces 211*a*, 211*b* and the deformation rate setting surfaces 213*a*, 213*b*. When the tantalum billet 10 is pressed by the second pressing mold 220, the bottom surface 218 presses the tantalum billet 10 at a side opposite to the second pressing mold 220 based on the tantalum billet 10.

The deformation restricting surfaces 211*a*, 211*b* are brought into contact with surfaces of the tantalum billet 10 in the first direction so as to restrict a plastic deformation of the tantalum billet 10 in the first direction. The tantalum billet 10 having a rectangular prism shape has two surfaces in the first direction. In this regard, the second base mold 210 also has two deformation restricting surfaces 211*a*, 211*b*. The deformation restricting surfaces 211*a*, 211*b* are located at a side opposite to each other along the first direction (X) based on the tantalum billet 10 which is received in the first base mold 210.

The deformation restricting surfaces 211*a*, 211*b* are brought into contact with surfaces of the tantalum billet 10 in the first direction. Accordingly, even though external force is applied to the tantalum billet 10, the deformation restricting surfaces 211*a*, 211*b* may restrict a plastic deformation of the tantalum billet 10 in the first direction.

The deformation restricting surfaces 213*a*, 213*b* are spaced apart from surfaces of the tantalum billet 10 in the third direction so as to set a deformation rate of the tantalum billet 10 in the third direction (Z). The tantalum billet 10 having a rectangular prism shape has two surfaces in the third direction. In this regard, the first base mold 210 also has two deformation rate setting surfaces 213*a*, 213*b*. The deformation rate setting surfaces 213*a*, 213*b* are disposed at a side opposite to each other along the third direction (Z) based on the tantalum billet 10 which is received in the first base mold 210.

The deformation restricting surfaces 213*a*, 213*b* are spaced apart from surfaces of the tantalum billet 10 in the third direction. Accordingly, when external force is applied to the tantalum billet 10, the tantalum billet 10 may be plastically deformed in the third direction (Z). When external force is sufficiently applied, the plastic deformation of the tantalum billet 10 in the third direction (Z) is carried out until the tantalum billet 10 is brought into contact with the deformation rate setting surfaces 213*a*, 213*b*, and as a result, the deformation rate setting surfaces 213*a*, 213*b* may set the deformation rate (or the deformation amount) of the tantalum billet 10. The deformation rate setting surfaces 213*a*, 213*b* may also be referred to as deformation amount setting surfaces.

The deformation rate (or the deformation amount) of the tantalum billet 10 may be determined according to the distance between the tantalum billet 10 which is received in the second base mold 210 and the deformation rate setting surfaces 213*a*, 213*b*. If the deformation rate of the tantalum billet 10 is intended to be set at a relatively small value, the deformation rate setting surfaces 213*a*, 213*b* need to be disposed relatively close to the tantalum billet 10. If the deformation rate of the tantalum billet 10 is intended to be set at a relatively large value, the deformation rate setting surfaces 213*a*, 213*b* need to be disposed relatively far away from the tantalum billet 10. The deformation rate (or the deformation amount) of the tantalum billet 10 is set as a value in which the tantalum billet 10 is restored to a shape prior to the upset forging.

The second pressing mold 220 is composed so as to press the surface of the tantalum billet 10 in the second direction. When the second pressing mold 220 presses one of the two surfaces of the tantalum billet 10 in the second direction, the bottom surface 218 of the second base mold 210 also presses the other surface of the tantalum billet 10 in the second direction by the action-reaction law.

The come-back forging after the upset forging is performed by disposing the tantalum billet 10 in the second base mold 210 and pressing the tantalum billet 10 by means of the second pressing mold 220. By performing the come-back forging, the tantalum billet 10 has no change in the first direction (X), is compressed in the second direction (Y), and is protruded in the third direction (Z), and as a result, the tantalum billet 10 is restored to the shape prior to the upset forging.

The come-back forgings performed on the tantalum billet 10 in different directions may be performed by varying the directions in which the tantalum billet 10 is disposed in the second base mold 210.

Figure 10A:
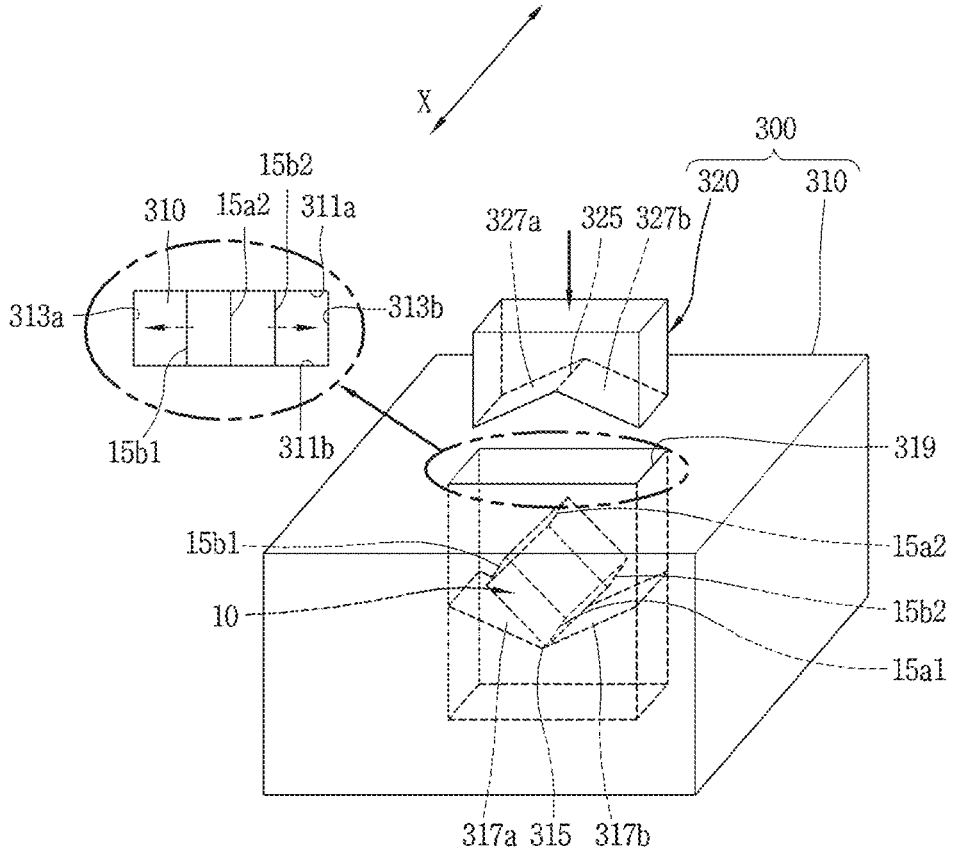
FIGS. 10*a* and 10*b* are conceptual views illustrating a third jig on which wedge forging is performed and a tantalum billet which is plastically processed by the third jig.
Figure 10B:
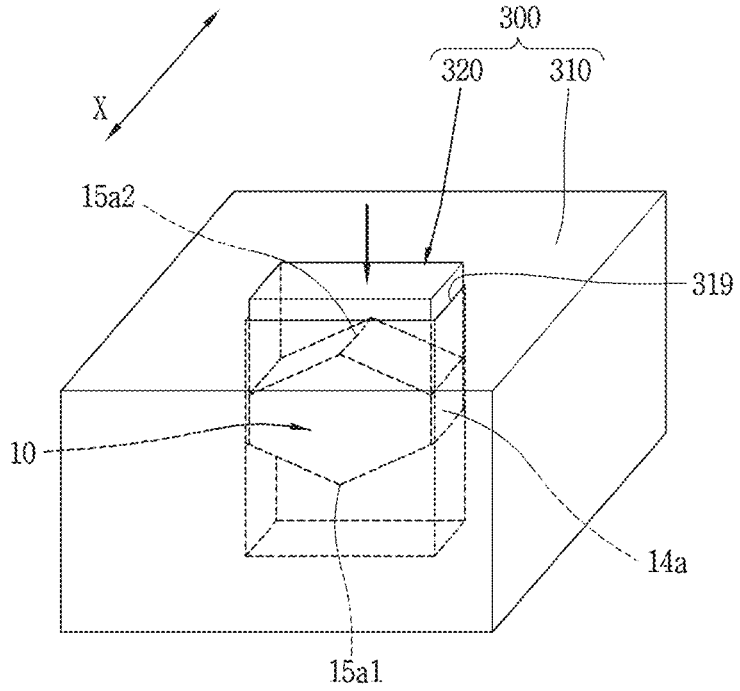

FIGS. 10*a* and 10*b* are conceptual views illustrating a third jig 300 on which wedge forging is performed and a tantalum billet 10 which is plastically processed by the third jig 300. FIG. 10*a* illustrates a state before pressing the tantalum billet 10. FIG. 10*b* illustrates a state after pressing the tantalum billet 10.

The wedge forging may be performed by using the third jig 300. The third jig 300 includes a third base mold 310 and a third pressing mold 320.

The third base mold 310 is composed so as to receive the tantalum billet 10. The third base mold 310 includes deformation restricting surfaces 311*a*, 311*b*, a first pressing corner 315, first pressing inclined surfaces 317*a*, 317*b*, and height surfaces 313*a*, 313*b*. The deformation restricting surfaces 311*a*, 311*b*, the first pressing corner 315, the first pressing inclined surfaces 317*a*, 317*b*, and the height surfaces 313*a*, 313*b* form a space 319 (a receiving portion) which receives the tantalum billet 10. The tantalum billet 10 is received in a space 319 (a receiving portion) formed by the deformation restricting surfaces 311*a*, 311*b*, the first pressing corner 315, the first pressing inclined surfaces 317*a*, 317*b*, and the height surfaces 313*a*, 313*b*.

The deformation restricting surfaces 311*a*, 311*b* are brought into contact with surfaces of the tantalum billet 10 facing one direction (X) so as to restrict a plastic deformation of the tantalum billet 10 in the one direction (X). The one surface (X) may be referred to as a deformation restricting direction (X) for convenience of explanation. There are two surfaces of the tantalum billet 10 facing the deformation restricting direction (X). In this regard, the third base mold 310 also has two deformation restricting surfaces 311*a*, 311*b*. The deformation restricting surfaces 311*a*, 311*b* are located at a side opposite to each other along the deformation restricting direction (X) based on the tantalum billet 10 which is received in the third base mold 310.

The deformation restricting surfaces 311*a*, 311*b* are brought into contact with surfaces of the tantalum billet 10. Accordingly, even though external force is applied to the tantalum billet 10, the deformation restricting surfaces 311*a*, 311*b* may restrict a plastic deformation of the tantalum billet 10 in the deformation restricting direction (X).

The first pressing corner 315 supports a corner 15*a*1 of the tantalum billet 10 which is received in the third base mold 310. When the tantalum billet 10, which is received in the third base mold 310, is pressed by the third pressing mold 320, the first pressing corner 315 presses the corner 15*a*1 of the tantalum billet 10.

The tantalum billet 10 has four corners 15*a*1, 15*a*2, 15*a*3, and 15*a*4 parallel to the deformation restricting direction (X). Among the four corners, any two corners 15*a*1, 15*a*2 located in a direction diagonal to each other are pressed by the first pressing corner 315 and the second pressing corner 325, respectively. The second pressing corner 325 is a constituent element included in the third pressing mold 320, and the second pressing corner 325 will be described below.

The first pressing inclined surfaces 317*a*, 317*b* are formed to be inclined symmetrically at both sides of the first pressing corner 315 so as to set the deformation rate (or the deformation amount) of the tantalum billet 10. Before the tantalum billet 10 is pressed by the third pressing mold 320, the first pressing inclined surfaces 317*a*, 317*b* are spaced apart from the surface of the tantalum billet 10. When external force is sufficiently applied, the plastic deformation of the tantalum billet 10 is carried out until the tantalum billet 10 is brought into contact with the first pressing inclined surfaces 317*a*, 317*b*, and as a result, the first pressing inclined surfaces 317*a*, 317*b* may set the deformation rate of the tantalum billet 10.

When external force is applied to the tantalum billet 10, the tantalum billet 10 may be plastically deformed in a form corresponding to the first pressing inclined surfaces 317*a*, 317*b*. Two surfaces are located at both sides of the corner 15*a*1 of the tantalum billet 10 pressed by the first pressing corner 315. Before the tantalum billet 10 is pressed by the third pressing mold 320, an angle in which the two surfaces meet is substantially 90°. When the tantalum billet 10 is pressed by the third pressing mold 320, an angle in which two surfaces meet is deformed into an obtuse angle. The obtuse angle is the same as an angle between the first pressing inclined surfaces 317*a*, 317*b*.

The deformation rate (or the deformation amount) of the tantalum billet 10 may be set according to the angle in which the first pressing inclined surfaces 317*a*, 317*b* meet. An angle between the first pressing inclined surfaces 317*a*, 317*b* may be set at 100° to 170°. If the deformation rate of the tantalum billet 10 is intended to be set at a relatively small value, the angle between the first pressing inclined surfaces 317*a*, 317*b* is formed at an angle close to 100°. If the deformation rate of the tantalum billet 10 is intended to be set at a relatively large value, the angle between the first pressing inclined surfaces 317*a*, 317*b* is formed at an angle close to 170°. Likewise, the deformation rate (or the deformation amount) of the tantalum billet 10 may be set according to the angle in which the second pressing inclined surfaces 327*a*, 327*b* meet.

The height surfaces 313*a*, 313*b* are spaced apart from the tantalum billet 10 which is received in the third base mold 310 so as to set the deformation rate (or the deformation amount) of the tantalum billet 10 and deform the tantalum billet 10 into an octahedron. The tantalum billet 10 has four corners 15*a*1, 15*a*2, 15*b*1, and 15*b*2 parallel to the deformation restricting direction (X). Among the four corners, any two corners 15*a*1, 15*a*2 located in a direction diagonal to each other are pressed by the first pressing corner 315 and the second pressing corner 325. Moreover, the other two corners 15*b*1, 15*b*2 face the height surfaces 313*a*, 313*b* at a side opposite to each other.

When the tantalum billet 10 is pressed by the third pressing mold 320, the height surfaces 313*a*, 313*b* deform the other two corners 15*b*1, 15*b*2 into a surface. Accordingly, the tantalum billet 10 is deformed from a shape of a hexahedron in which two surfaces are disposed at both ends of corners (a structure in which two surfaces are disposed at both sides of the corner 15*b*1 and two surfaces are disposed at both sides of the corner 15*b*2) to a shape of an octahedron in which two surfaces are disposed at both sides of the surface (a structure in which two surfaces are disposed at both sides of a surface formed by plastically deforming the corner 15*b*1 and two surfaces are disposed at both sides of a surface formed by plastically deforming the corner 15*b*2).

The third pressing mold 320 includes a second pressing corner 325 and second pressing inclined surfaces 327*a*, 327*b*.

The second pressing corner 325 is composed so as to press the corner 15*a*2 located in a direction diagonal to the corner 15*a*1 supported by the first pressing corner 315. The corner 15*a*2 pressed by the second pressing corner 325 is one of the corners 15*a*1, 15*a*2, 15*b*1, and 15*b*2 parallel to the deformation restricting direction (X).

The second pressing inclined surfaces 327*a*, 327*b* are formed to be inclined symmetrically at both sides of the second pressing corner 325 so as to set the deformation rate (or the deformation amount) of the tantalum billet 10. When external force is sufficiently applied by the third pressing mold 320, the plastic deformation of the tantalum billet 10 is carried out until the tantalum billet 10 is brought into contact with the second pressing inclined surfaces 327*a*, 327*b*, and as a result, the second pressing inclined surfaces 327*a*, 327*b* may set the deformation rate of the tantalum billet 10.

When external force is applied to the tantalum billet 10, the tantalum billet 10 may be plastically deformed in a form corresponding to the second pressing inclined surfaces 327*a*, 327*b*. Two surfaces are located at both sides of the corner 15*a*2 of the tantalum billet 10 pressed by the second pressing corner 325. Before the tantalum billet 10 is pressed by the third pressing mold 320, an angle in which the two surfaces meet is substantially 90°. When the tantalum billet 10 is pressed by the third pressing mold 320, an angle in which the two surfaces meet is deformed into an obtuse angle. The obtuse angle is the same as an angle between the second pressing inclined surfaces 327*a*, 327*b*.

The deformation rate of the tantalum billet 10 may be set according to the angle in which the second pressing inclined surfaces 327*a*, 327*b* meet. An angle between the second pressing inclined surfaces 327*a*, 327*b* may be set at 100° to 170°. If the deformation rate of the tantalum billet 10 is intended to be set at a relatively small value, the angle between the second pressing inclined surfaces 327*a*, 327*b* is formed at an angle close to 100°. If the deformation rate of the tantalum billet 10 is intended to be set at a relatively large value, the angle between the second pressing inclined surfaces 327*a*, 327*b* is formed at an angle close to 170°. The angle between the first pressing inclined surfaces 317*a*, 317*b* may be substantially the same as the angle between the second pressing inclined surfaces 327*a*, 327*b*.

When the third pressing mold 320 presses the tantalum billet 10, the third base mold 310 also presses the tantalum billet 10 by the action-reaction law.

The wedge forging is performed by disposing the tantalum billet 10 in the third base mold 310 and pressing the tantalum billet 10 by means of the third pressing mold 320. By performing the wedge forging, the tantalum billet 10 has no change in the deformation restricting direction (X), and is deformed into a shape corresponding to the third pressing mold 320 and the third base mold 310 in the other directions. By performing the wedge forging, the tantalum billet 10 is deformed into an octahedron.

The wedge forgings performed on the tantalum billet 10 in different directions may be performed by varying the directions in which the tantalum billet 10 is disposed in the third base mold 310.

Figure 11A:
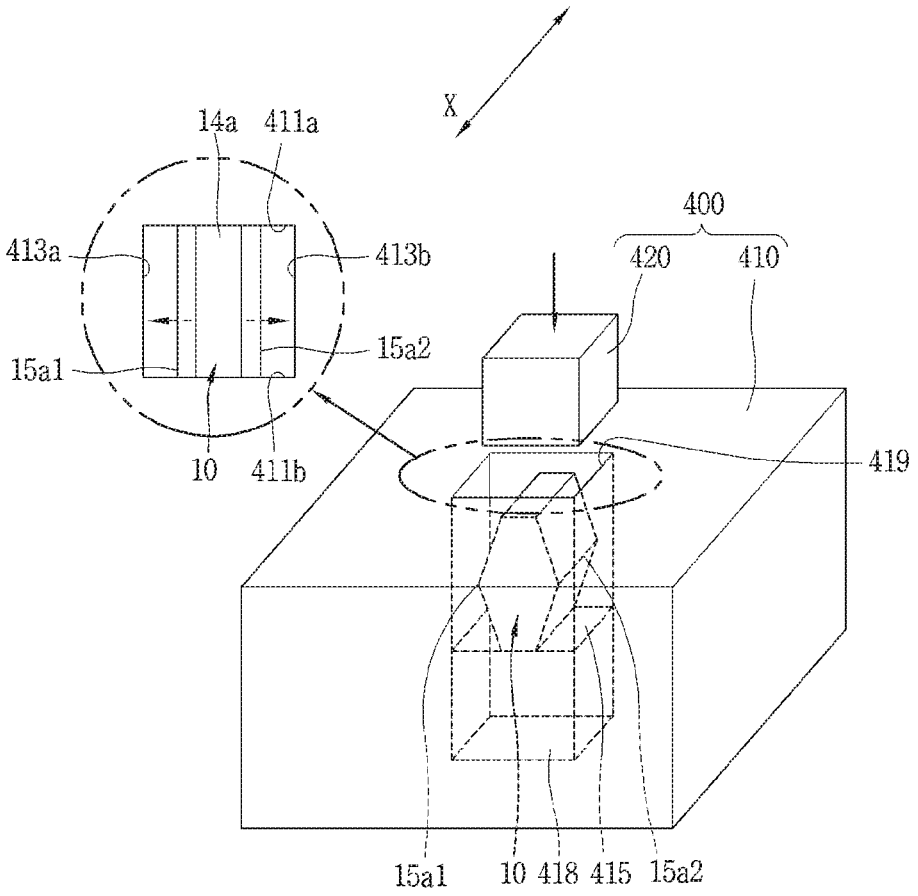
FIGS. 11*a* and 11*b* are conceptual views illustrating a fourth jig on which come-back forging is performed after the wedge forging and a tantalum billet which is restored to the original shape by the fourth jig.
Figure 11B:
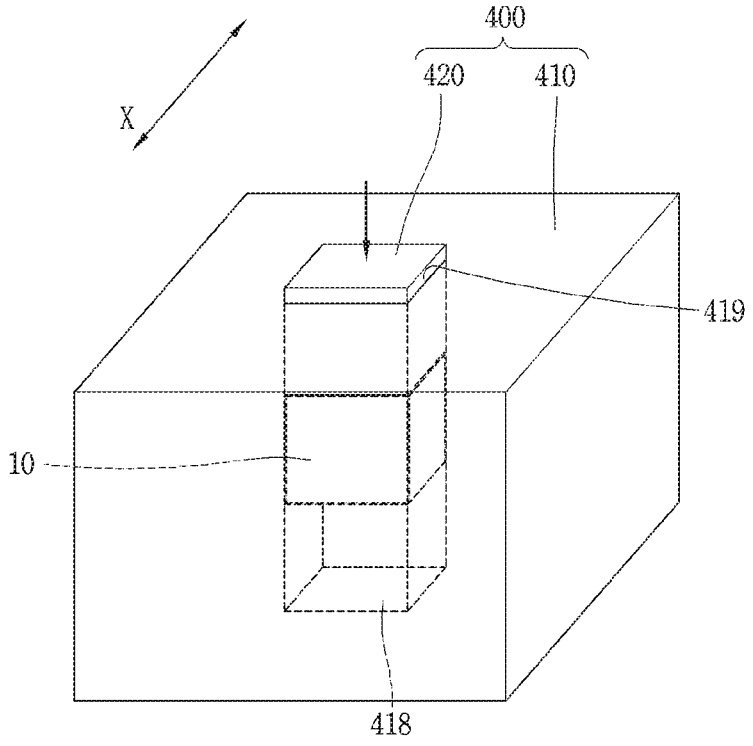

FIGS. 11*a* and 11*b* are conceptual views illustrating a fourth jig 400 on which come-back forging is performed after the wedge forging and a tantalum billet 10 which is restored to the original shape by the fourth jig 400. FIG. 11*a* illustrates a state before pressing the tantalum billet 10. FIG. 11*b* illustrates a state after pressing the tantalum billet 10.

The come-back forging after the wedge forging may be performed by using the fourth jig 400. The fourth jig 400 includes a fourth base mold 410 and a fourth pressing mold 420.

The fourth base mold 410 includes a receiving portion 419 formed so as to receive the tantalum billet 10. The receiving portion 419 has a shape corresponding to the original shape of the tantalum billet 10. The original shape means a shape before the wedge forging is performed on the tantalum billet 10.

The fourth base mold 410 includes a bottom surface 418, deformation restricting surfaces 411*a*, 411*b* and deformation rate setting surfaces 413*a*, 413*b*. The bottom surface 418, the deformation restricting surfaces 411*a*, 411*b*, and the deformation rate setting surfaces 413*a*, 413*b* form a receiving portion 419 which receives the tantalum billet 10. The shape of the receiving portion 419 corresponds to the original shape of the tantalum billet 10. The original shape means a shape before the wedge forging is performed on the tantalum billet 10. The deformation restricting surfaces 411*a*, 411*b* and the deformation rate setting surfaces 413*a*, 413*b* substantially form a height surface of the receiving portion 419. The tantalum billet 10 is received in the receiving portion 419 formed by the bottom surface 418, the deformation restricting surfaces 411*a*, 411*b*, and the deformation rate setting surfaces 413*a*, 413*b*. A planar pressing surface is provided at 415.

The bottom surface 418 supports the tantalum billet 10 which is received in the fourth base mold 410. An area of the bottom surface 418 may be determined by the deformation restricting surfaces 411*a*, 411*b* and the deformation rate setting surfaces 413*a*, 413*b*. When the tantalum billet 10 is pressed by a fourth pressing mold 420, the bottom surface 418 presses the tantalum billet 10 at a side opposite to the fourth pressing mold 420 based on the tantalum billet 10. Surfaces of the tantalum billet 10 pressed by the bottom surface 418 and the fourth pressing mold 420 are surfaces 14 formed by the wedge forging.

The deformation restricting surfaces 411*a*, 411*b* are brought into contact with surfaces of the tantalum billet 10 in one direction (X) so as to restrict a plastic deformation of the tantalum billet 10 in the one direction. The one surface (X) may be referred to as a deformation restricting direction (X) for convenience of explanation. The tantalum billet 10 has two surfaces facing the deformation restricting direction (X). In this regard, the fourth base mold 410 also has two deformation restricting surfaces 411*a*, 411*b*. The deformation restricting surfaces 411*a*, 411*b* are disposed at a side opposite to each other along the deformation restricting direction (X) based on the tantalum billet 10 which is received in the fourth base mold 410.

The deformation restricting surfaces 411*a*, 411*b* are brought into contact with faces facing the deformation restricting direction (X). Accordingly, even though external force is applied to the tantalum billet 10, the deformation restricting surfaces 411*a*, 411*b* may restrict a plastic deformation of the tantalum billet 10 in the deformation restricting direction (X). The deformation restricting direction (X) in the wedge forging is the same as the deformation restricting direction (X) in the come-back forging after the wedge forging.

The deformation rate surfaces 413*a*, 413*b* are spaced apart from the tantalum billet 10 so as to set the deformation rate (or the deformation amount) of the tantalum billet 10. The deformation rate setting surfaces 413*a*, 413*b* are disposed at a side opposite to each other based on the tantalum billet 10 which is received in the fourth base mold 410.

The deformation rate setting surfaces 413*a*, 413*b* are spaced apart from the tantalum billet 10. Accordingly, when external force is applied to the tantalum billet 10, the tantalum billet 10 may be plastically deformed. When external force is sufficiently applied, the plastic deformation of the tantalum billet 10 is carried out until the tantalum billet 10 is brought into contact with the deformation rate setting surfaces 413*a*, 413*b*, and as a result, the deformation rate setting surfaces 413*a*, 413*b* may set the deformation rate of the tantalum billet 10.

The deformation rate of the tantalum billet 10 may be set according to the distance between the tantalum billet 10 which is received in the fourth base mold 410 and the deformation rate setting surfaces 413*a*, 413*b*. If the deformation rate of the tantalum billet 10 is intended to be set at a relatively small value, the deformation rate setting surfaces 413*a*, 413*b* need to be disposed relatively close to the tantalum billet 10. If the deformation rate of the tantalum billet 10 is intended to be set at a relatively large value, the deformation rate setting surfaces 413*a*, 413*b* need to be disposed relatively far away from the tantalum billet 10. The deformation rate of the tantalum billet 10 is set as a value in which the tantalum billet 10 is restored to a shape prior to the wedge forging.

The deformation rate setting surfaces 413*a*, 413*b* are disposed so as to face corners 15*a*1, 15*a*2 pressed by the third base mold 310 and the third pressing mold 320 in the wedge forging. When a sufficient external force is applied to the tantalum billet 10, each of the corners 15*a*1, 15*a*2 and two surfaces disposed at both sides of the corner are deformed into one surface. Since two surfaces are deformed into one surface at one side of the tantalum billet 10 and two surfaces are also deformed into one surface at the other side, the tantalum billet 10 may be deformed from an octahedron to a hexahedron.

The fourth pressing mold 420 is composed so as to press one surface of the tantalum billet 10. One surface of the tantalum billet 10 pressed by the fourth pressing mold 420 is surfaces 14 (the other surface is not illustrated) formed by the wedge forging. When the fourth pressing mold 420 presses one surface 14 of the two surfaces 14 (the other surface is not illustrated) formed by the wedge forging, the bottom surface 418 of the fourth base mold 410 also presses the other surface (not illustrated) in the opposite direction by the action-reaction law.

The come-back forging after the wedge forging is performed by disposing the tantalum billet 10 in the fourth base mold 410 and pressing the tantalum billet 10 by means of the fourth pressing mold 420. By performing the come-back forging, the tantalum billet 10 is restored to a shape prior to the wedge forging.

The come-back forgings performed on the tantalum billet 10 in different directions may be performed by varying the directions in which the tantalum billet 10 is disposed in the fourth base mold 410.

Figure 12:
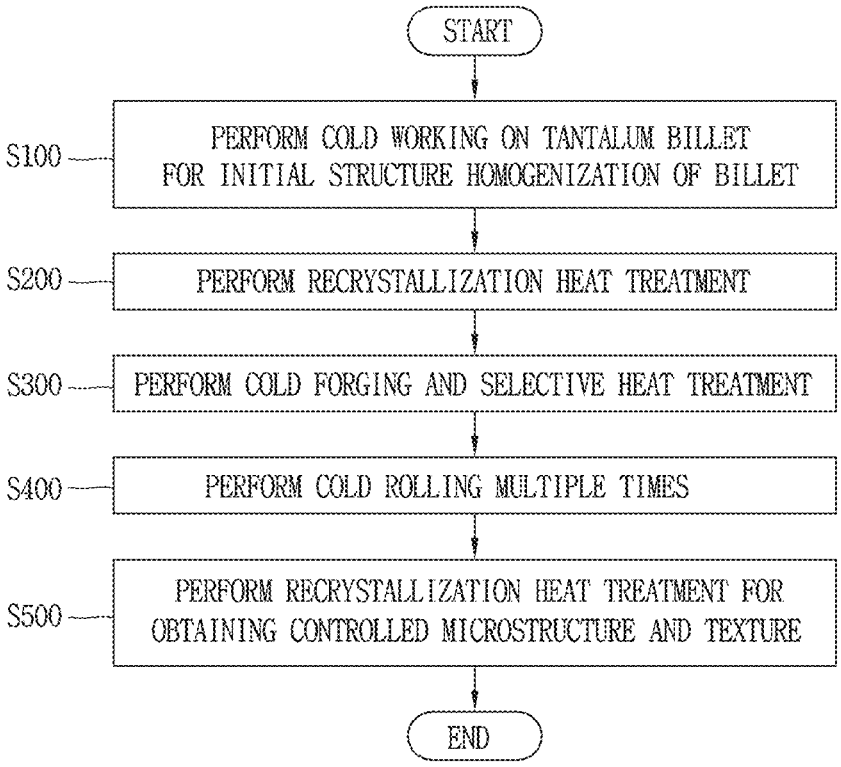
FIG. 12 is a flowchart of a method for controlling a microstructure and a texture of tantalum related to another example of the present invention.

FIG. 12 is a flowchart of a method for controlling a microstructure and a texture of tantalum related to another example of the present invention.

The reason that the method for controlling a microstructure and a texture of tantalum illustrated in FIG. 12 includes a step (S100) of performing cold working and a step (S400) of performing cold rolling is the same as the reasons previously described in FIGS. 4 to 11. Accordingly, the description with respect to this will be substituted with those previously described.

The method for controlling a microstructure and a texture of tantalum may further include a step (S200) of performing a recrystallization heat treatment, a step (S300) of performing cold forging and a selective heat treatment, and a step (S500) of performing a recrystallization heat treatment. The step (S200) of performing a recrystallization heat treatment, the step (S300) of performing cold forging and a selective heat treatment, and the step (S500) of performing a recrystallization heat treatment are steps which may be selectively added to the method for controlling a microstructure and a texture of tantalum illustrated in FIG. 4.

After the step (S100) of performing cold working, the step (S200) of performing a recrystallization heat treatment is carried out at 800° C. to 1,400° C. for 1 minute to 5 hours. The recrystallization heat treatment controls the crystal size of a tantalum billet to 100 μm or less, preferably 50 μm or less. Further, the recrystallization heat treatment controls an orientation distribution function and a development intensity of a pole intensity of a tantalum billet to a texture distribution of 3 or less, and to strictly a texture distribution of 2 or less.

When the recrystallization heat treatment temperature is too low or the recrystallization heat treatment time is extremely short, the recrystallization of tantalum may not be sufficiently carried out. Further, when the recrystallization heat treatment temperature is too high or the recrystallization heat treatment time is extremely long, growth of coarse crystal grains or growth of abnormal particles of tantalum may be caused. Accordingly, it is preferred to perform a recrystallization heat treatment at a temperature higher than the crystallization temperature of tantalum for approximately 1 hour.

Subsequently, cold working and a selective heat treatment are performed on a tantalum billet completely subjected to initial structure homogenization by performing the recrystallization heat treatment (S300).

The cold forging is performed as a uniaxial cold forging having a thickness decrease rate of 40% or more. Since a tantalum billet has a rectangular prism shape such as a rectangular parallelepiped or a regular hexahedron, it is difficult to perform cold rolling. Accordingly, there is a need for a procedure to make a tantalum billet flat in advance through cold forging before the cold rolling is performed. The cold forging can make the tantalum billet flat.

The selective heat treatment is performed at 800° C. to 1,400° C. for 1 minute to 5 hours. The selective heat treatment is also for the recrystallization of tantalum. When the selective heat treatment temperature is too low or the selective heat treatment time is extremely short, the recrystallization of tantalum may not be sufficiently carried out. Further, when the selective heat treatment temperature is too high or the selective heat treatment time is extremely long, growth of coarse crystal grains or growth of abnormal particles of tantalum may be caused. Accordingly, it is preferred to perform a selective heat treatment at a temperature higher than the crystallization temperature of tantalum for approximately 1 hour.

The selective heat treatment means that the heat treatment is not an essential step. Accordingly, after the cold forging is performed, a heat treatment may be performed or may not be performed. It may be determined according to the microstructure and the texture to be controlled whether the selective heat treatment is performed.

After a step (S300) of performing cold forging and a selective heat treatment, cold rolling is performed on the tantalum billet multiple times (S400). As the cold rolling is performed, the tantalum billet is processed into a tantalum plate.

After the step (S400) of performing the cold rolling, a recrystallization heat treatment is finally performed (S500). A recrystallization heat treatment after the step (S100) of performing the cold working in advance may be referred to as a primary recrystallization heat treatment (S200) and a recrystallization heat treatment after the step (S400) of performing the cold rolling may be referred to as a secondary recrystallization heat treatment (S500) to differentiate the two recrystallization heat treatment from each other.

The secondary recrystallization heat treatment (S500) is performed at 800° C. to 1,400° C. for 1 minute to 5 hours. The secondary recrystallization heat treatment is for finally controlling a microstructure and a texture of tantalum. Detailed secondary recrystallization heat treatment temperature and time may be determined according to the total reduction ratio imparted to tantalum in the step (S400) of performing the cold rolling. Since a high total reduction ratio imparted to tantalum means that stress accumulated on tantalum is high, the secondary recrystallization heat treatment may be relatively lowered. In contrast, since a low total reduction ratio imparted to tantalum means that stress accumulated on tantalum is low, the secondary recrystallization heat treatment needs to be relatively high.

In the microstructure of the tantalum plate completely subjected to the secondary recrystallization heat treatment (S500), the crystal size is controlled to 50 μm, preferably 25 μm or less.

Further, in the texture of the tantalum plate completely subjected to the secondary recrystallization heat treatment (S500), at least one crystal plane of {111}, {100}, and {110} is preferentially oriented parallel to a plate surface of the tantalum plate. Since the present invention may preferentially orient at least one crystal plane selectively parallel to the plate surface, the present invention may selectively develop a texture of tantalum.

The step (S100) of performing cold working and the step (S400) of performing cold rolling are essential steps for controlling the microstructure and the texture of tantalum. In contrast, the step (S200) of performing the primary recrystallization heat treatment, the step (S300) of performing cold forging and a selectively heat treatment, and the step (S500) of performing a secondary recrystallization heat treatment are selective steps for controlling the microstructure and the texture of tantalum. The selective steps are added to the essential steps, and as a result, various controlling methods may be combined.

For explanation by taking an example, a step (S100) of performing cold working will be referred to as a first step, a step (S200) of performing a primary recrystallization heat treatment will be referred to as a second step, a step (S300) of performing cold forging and a selective heat treatment will be referred to as a third step, a step (S400) of performing cold rolling will be referred to as a fourth step, and a step (S500) of performing a secondary recrystallization heat treatment will be referred to as a fifth step. The methods for controlling the microstructure and the texture of tantalum may be combined as follows.

Controlling Method 1: First Step and Fourth Step

Controlling Method 2: First Step, Second Step, and Fourth Step

Controlling Method 3: First Step, Third Step, and Fourth Step

Controlling Method 4: First Step, Fourth Step, and Fifth Step

Controlling Method 5: First Step, Second Step, Third Step, and Fourth Step

Controlling Method 6: First Step, Second Step, Fourth Step, and Fifth Step

Controlling Method 7: First Step, Third Step, Fourth Step, and Fifth Step

Controlling Method 8: First Step, Second Step, Third Step, Fourth Step, and Fifth Step Hereinafter, Examples of the present invention will be described.

In each Example, a tantalum billet used to control a microstructure and a texture was prepared by the following procedure. First, a tantalum raw material having a purity of 99.9997% was dissolved by electron beam and cast into a rod shape having a diameter of 40 mm, and the rod-shaped tantalum was forged into a rectangular prism with a breadth×a length×a height=40 mm×40 mm×40 mm.

An initial shape of the thus prepared tantalum billet is illustrated in FIG. 1. An initial microstructure of the tantalum billet is illustrated in FIG. 2. An initial texture of the tantalum billet is illustrated in FIG. 3. As can be confirmed in FIG. 2, the initial microstructure of the tantalum billet has a coarse crystal size. As can be confirmed in FIG. 3, the initial texture of the tantalum billet is heterogeneous.

The following Examples are composed of Example 1 to Example 4. The process conditions in each Example can be summarized as in Table 1.

TABLE 1

| Example | Cold working | Recrystallization heat treatment | Cold forging | Selective heat treatment | Cold rolling | Recrystallization heat treatment |
|---|---|---|---|---|---|---|
| 1 | ○ | 1,050° C., 1 hour | ○ | 1,050° C., 1 hour | 60° | 1,150° C., 30 minutes |
| 2 | ○ | 1,050° C., 1 hour | ○ | 1,050° C., 1 hour | 90° | 1,150° C., 30 minutes |
| 3 | ○ | 1,050° C., 1 hour | ○ | 1,050° C., 1 hour | 60° | 1,150° C., 30 minutes |
| 4 | ○ | 1,050° C., 1 hour | ○ | 1,050° C., 1 hour | 90° | 1,150° C., 30 minutes |

Hereinafter, each Example will be described.

Example 1

1-1. First Step: Step of Performing Cold Working on Tantalum Billet

A deformation rate of 20% is added to a tantalum billet in a height direction by performing a primary upset forging on the tantalum billet. The height of the tantalum billet on which the primary upset forging is performed is processed into 32 mm. A primary come-back forging is performed on the tantalum billet on which the primary upset forging is performed to again restore the tantalum billet into a rectangular prism with 40 mm×40 mm×40 mm.

Subsequently, a secondary upset forging having a deformation rate of 20% is performed on a breadth direction of the tantalum billet, and a secondary come-back forging is performed on the breadth direction. A tertiary upset forging having a deformation rate of 20% is also performed on a length direction of the tantalum billet, and a tertiary drawback is performed on the length direction.

A wedge forging is performed on the tantalum billet completely subjected to each of upset forging and come-back forging in breadth, length, and height directions.

The tantalum billet is processed from a rectangular prism to an octahedron by performing a primary wedge forging while maintaining the height of the tantalum billet at 40 mm. Subsequently, a primary come-back forging is performed on the octahedral tantalum billet to again restore the tantalum billet into a rectangular prism with 40 mm×40 mm×40 mm.

Subsequently, a secondary wedge forging is performed while maintaining a length of the breadth of the tantalum billet at 40 mm, and a secondary come-back forging is performed. A tertiary wedge forging is performed while maintaining a length of the length of the tantalum billet at 40 mm, and a tertiary come-back forging is performed.

1-2. Second Step: Step of Performing Primary Recrystallization Heat Treatment

A primary recrystallization heat treatment was performed on the tantalum billet completely subjected to cold working at 1,050° C. for 1 hour.

Figure 13:
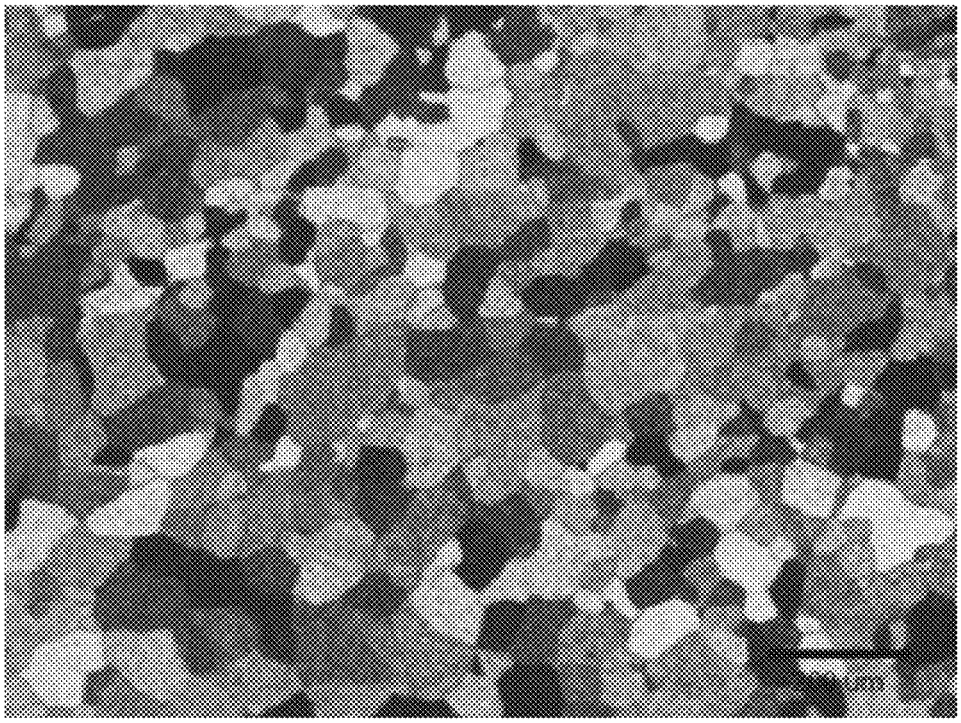
FIG. 13 is a microstructure photograph of tantalum after the step of performing the cold working and the step of performing the primary recrystallization heat treatment.

FIG. 13 is a microstructure photograph of tantalum after the step of performing the cold working and the step of performing the primary recrystallization heat treatment.

Tantalum before controlling the microstructure and the texture exhibits a cast structure having coarse crystal grains, whereas the tantalum on which cold working and the primary recrystallization heat treatment are performed has a crystal size of 50 μm or less.

In FIG. 13, it can be confirmed that the crystal size of tantalum is micronized by cold working and the primary recrystallization heat treatment.

Figure 14:
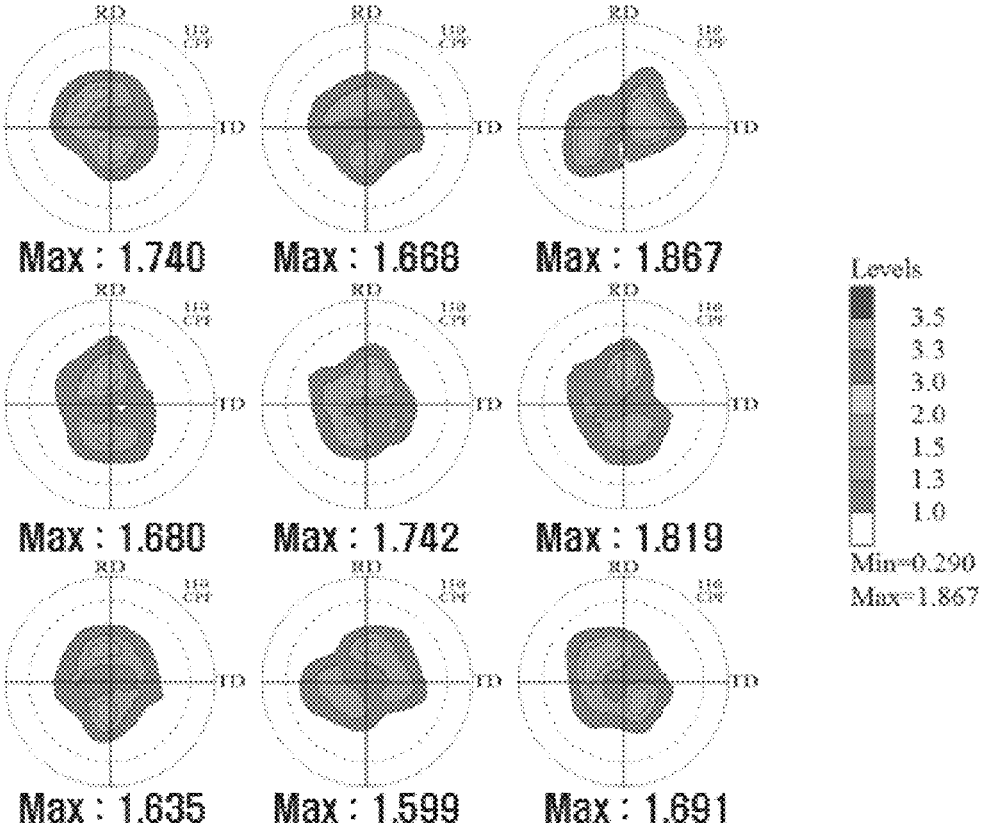
FIG. 14 is a pole figure illustrating a texture of tantalum after the step of performing the cold working and the step of performing the primary recrystallization heat treatment.

FIG. 14 is a pole figure illustrating a texture of tantalum after the step of performing the cold working and the step of performing the primary recrystallization heat treatment.

The tantalum on which the cold working and the primary heat treatment are performed has a heterogeneous and random texture having an orientation distribution function value of 2 or less and a development intensity value of a pole intensity of 2 or less. From the fact, it can be seen that the texture of tantalum is homogenized by the cold working and the primary recrystallization heat treatment.

1-3. Third Step: Step of Performing Cold Working and Selective Heat Treatment

Through a uniaxial cold forging process, tantalum is processed into tantalum having a thickness of 20 mm to 24 mm.

The selective heat treatment was performed at 1,050° C. for 1 hour.

1-4. Fourth Step: Step of Performing Cold Rolling on Tantalum Billet

A cold rolling was performed by setting the rotation angle of the tantalum billet at 60° every time, and setting the total reduction ratio at 80%. As the rotation angle was set at 60° every time, the rolling was performed six times, and an every reduction ratio was set so as to have a final thickness of 5 mm or less.

The tantalum billet was processed into a tantalum plate by the cold rolling.

1-5. Fifth Step: Step of Performing Secondary Recrystallization Heat Treatment

A secondary recrystallization heat treatment was performed on the tantalum plate completely subjected to cold rolling at 1,150° C. for 30 minutes.

Example 2

2-1. First Step: Step of Performing Cold Working on Tantalum Billet

A cold working is performed in the same manner as in the first step of Example 1.

2-2. Second Step: Step of Performing Primary Recrystallization Heat Treatment

A primary recrystallization heat treatment is performed in the same manner as in the second step of Example 1.

2-3. Third Step: Step of Performing Cold Forging and Selective Heat Treatment

A cold forging and a selective heat treatment are performed in the same manner as in the third step of Example 1.

2-4. Fourth Step: Step of Performing Cold Rolling on Tantalum Billet

A cold rolling was performed by setting the rotation angle of the tantalum billet at 90° every time, and setting the total reduction ratio at 80%. As the rotation angle was set at 90° every time, the rolling was performed four times, and an every reduction ratio was set so as to have a final thickness of 5 mm or less.

The tantalum billet was processed into a tantalum plate by the cold rolling.

2-5. Fifth Step: Step of Performing Secondary Recrystallization Heat Treatment

A secondary recrystallization heat treatment is performed in the same manner as in the fifth step of Example 1.

Example 3

3-1. First Step: Step of Performing Cold Working on Tantalum Billet

A cold working is performed in the same manner as in the first step of Example 1.

3-2. Second Step: None 3-3. Third Step: Performing Only Cold Forging and Performing No Selective Heat Treatment A cold forging is performed in the same manner as in the third step of Example 1.

A selective heat treatment is not performed.

3-4. Fourth Step: Step of Performing Cold Rolling on Tantalum Billet

A cold rolling is performed in the same manner as in the fourth step of Example 1.

3-5. Fifth Step: Step of Performing Recrystallization Heat Treatment

A recrystallization heat treatment is performed in the same manner as in the fifth step of Example 1.

Example 4

4-1. First Step: Step of Performing Cold Working on Tantalum Billet

A cold working is performed in the same manner as in the first step of Example 1.

4-2. Second Step: None 4-3. Second Step: Performing Only Cold Forging and Performing No Selective Heat Treatment A cold working is performed in the same manner as in the third step of Example 1.

A selective heat treatment is not performed.

4-4. Fourth Step: Step of Performing Cold Rolling on Tantalum Billet

A cold rolling is performed in the same manner as in the fourth step of Example 2.

4-5. Fifth Step: Step of Performing Recrystallization Heat Treatment

A recrystallization heat treatment is performed in the same manner as in the fifth step of Example 1.

Figure 15:
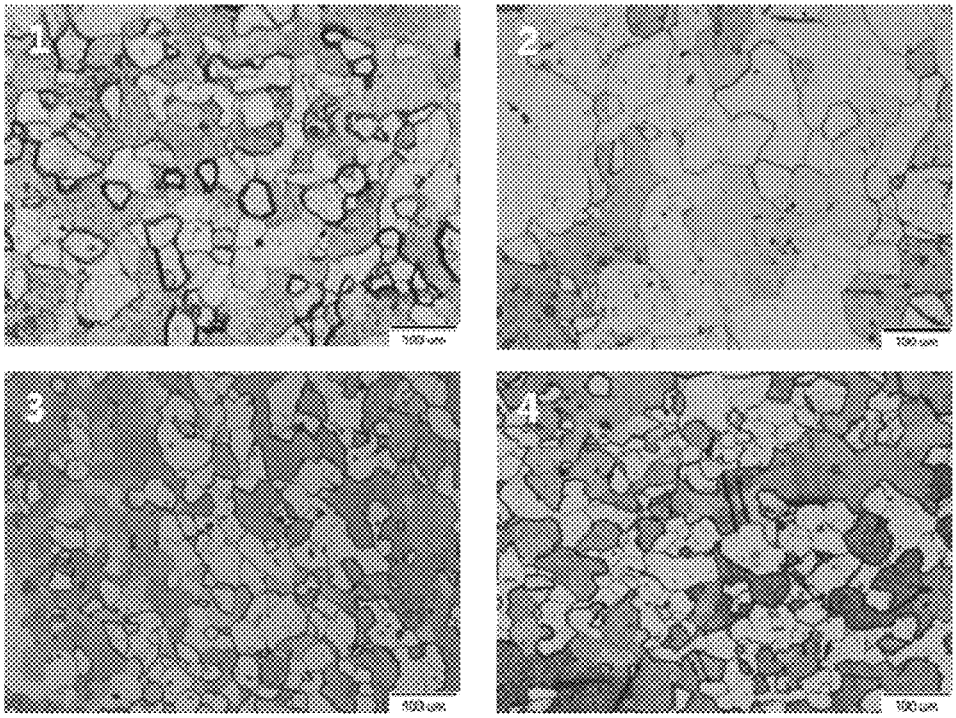
FIG. 15 is a photograph illustrating each example of the microstructure of tantalum after the processes of the first example to the fourth example are completed.

FIG. 15 is photograph illustrating each example of the microstructure of tantalum after the processes of the first example to the fourth example are completed.

1 to 4 marked in the photograph mean the results of Examples 1 to 4. There is a slight difference for each Example, but it can be confirmed that the crystal size of tantalum is controlled to about 50 μm or less. In particular, the crystal size of tantalum is also controlled to about 25 μm or less according to the Example.

Figure 16:
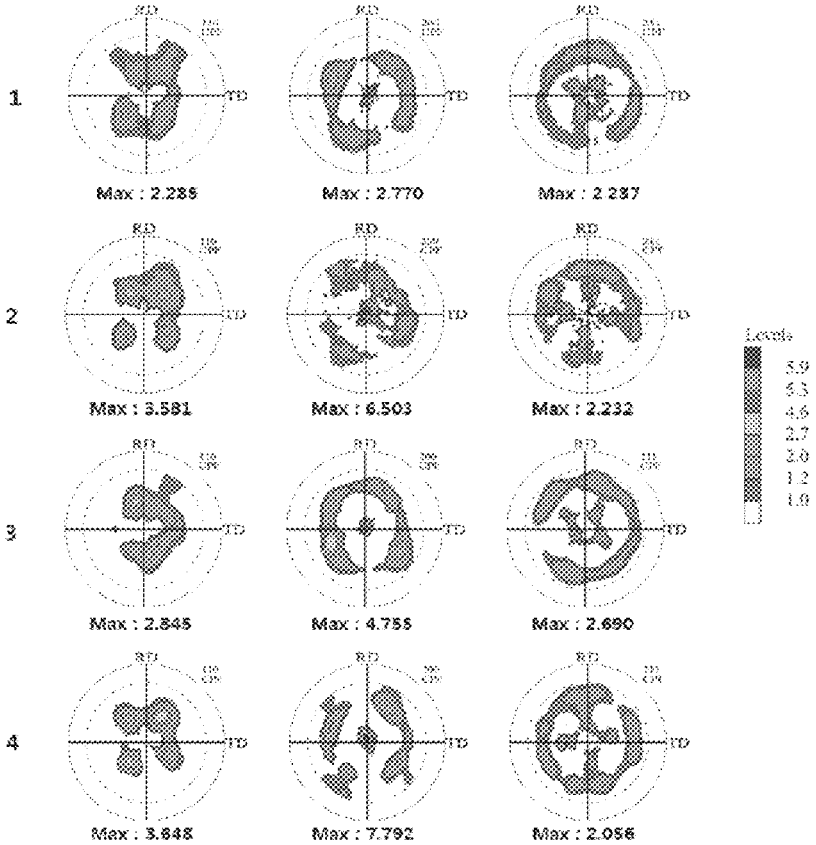
FIG. 16 is a pole figure illustrating each example of the texture of tantalum after the processes of the first example to the fourth example are completed.

FIG. 16 a pole figure illustrating each example of the texture of tantalum after the processes of the first example to the fourth example are completed.

1 to 4 marked in the pole figure mean the results of Examples 1 to 4. Further, 110, 200, and 211 marked on the upper right side of the pole figure mean a crystal plane of tantalum, and represent the pole figures of the {110}, {200}, and {211} crystal planes, respectively.

For the textures of tantalum according to Examples 1 to 4, different crystallographic orientations are preferentially developed, and the development intensity thereof also exhibits a significant difference from about 2.3 to about 3.6 as can be seen from the pole figure of the {110} crystal plane. From the observation, it can be seen that the present invention can control the texture of tantalum and the development intensity thereof differently from each other according to each Example.

Figure 17:
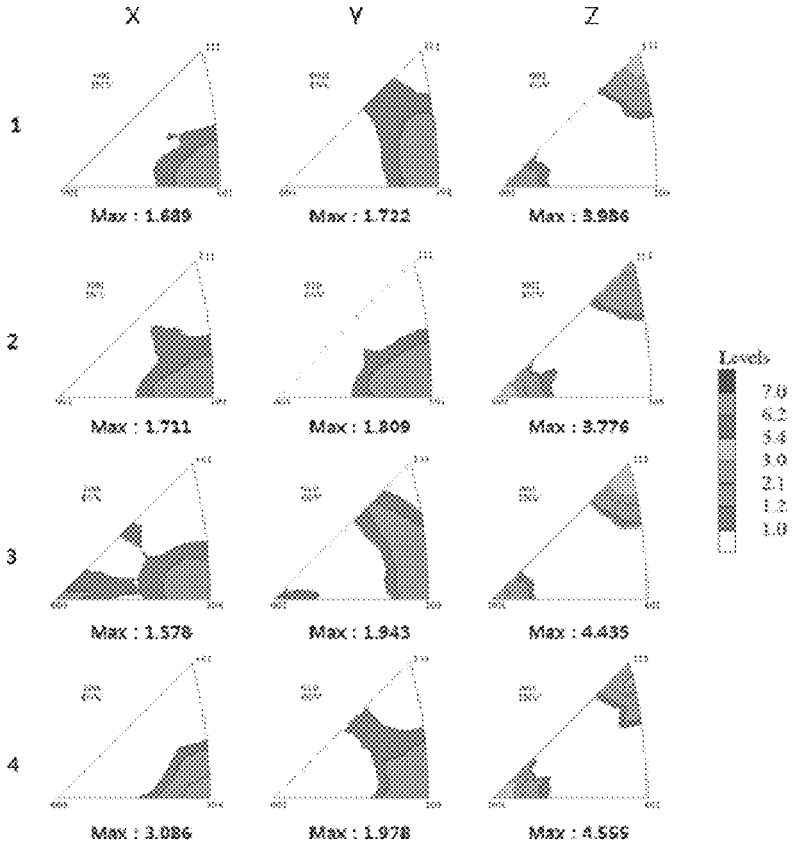
FIG. 17 is an inverse pole figure illustrating each example of the texture of tantalum after the processes of the first example to the fourth example are completed.

FIG. 17 is an inverse pole figure illustrating each example of the texture of tantalum after the processes of the first example to the fourth example are completed.

1 to 4 marked in the inverse pole figure mean the results of Examples 1 to 4. Moreover, X, Y, and Z mean each axis of a tantalum plate. The X-axis means a rolling direction of the plate. The Y-axis means a transverse direction which is parallel to the plate surface and perpendicular to the rolling direction. Accordingly, X-Y means a plate surface. The Z-axis means a normal direction of a plate surface. The present invention relates to controlling a specific crystal plane of tantalum so as to orient the specific crystal plane of tantalum in a direction parallel to the normal direction of a plate surface. Accordingly, it is the Z-axis that needs to be carefully observed in the inverse pole figure.

In Example 1, the {111} crystal plane of tantalum was preferentially oriented parallel to a plate surface of a tantalum plate.

In Example 2, the {001} crystal plane of tantalum was preferentially oriented parallel to a plate surface of a tantalum plate. The {001} crystal plane is a crystal plane which is the same as the {100} crystal plane.

In Example 3, the {111} crystal plane of tantalum was preferentially oriented parallel to a plate surface of a tantalum plate.

In Example 4, the {111} and {001} crystal planes of tantalum were preferentially oriented parallel to a plate surface of a tantalum plate. The {001} crystal plane is a crystal plane which is the same as the {100} crystal plane.

As described above, the present invention may control the microstructure of tantalum and may preferentially orient the texture of tantalum in a selectively specific direction by combining process conditions.

The method for controlling a microstructure and a texture of tantalum as described above is not limited by the configurations and methods of the Examples as described above, but the Examples may also be configured by selectively combining a whole or part of the Examples, such that various modifications can be made.

INDUSTRIAL APPLICABILITY

The present invention may be used in the industrial field which requires tantalum of which a microstructure and a texture are controlled.

What is claimed is:

1. A method for controlling a microstructure and a texture of tantalum, the method comprising the steps of performing cold working on a tantalum billet having a rectangular prism shape; and performing cold rolling multiple times, wherein the step of performing the cold working comprises:

a first forging step of performing upset forging and come-back forging on the tantalum billet multiple times in different directions, the upset forging being performed to press two surfaces of the tantalum billet so as to make the two surfaces to be pressed to each other and the come-back forging being performed to restore the tantalum billet to the rectangular prism shape; and a second forging step of performing wedge forging and come-back forging on the tantalum billet multiple times in different directions, the wedge forging being performed to press two corners located in a diagonal direction of the tantalum billet and parallel to each other so as to make the two corners to be pressed to each other and the come-back forging being performed to restore the tantalum billet to the rectangular prism shape, wherein the first forging step includes:

a step of performing a primary upset forging in a first direction and performing a primary come-back forging, after performing the primary come-back forging, a step of performing a secondary upset forging in a second direction different from the first direction, and performing a second come-back forging, and after performing the second come-back forging, a step of performing a tertiary upset forging in a third direction different from the first and the second directions, and performing a tertiary come-back forging, wherein the second forging step includes:

a step of performing a primary wedge forging by pressing two corners in a first diagonal direction which is inclined with respect to at least one of the first, the second, and the third directions, and performing a primary come-back forging of the second forging step, after performing the primary come-back forging of the second forging step, a step of performing a second wedge forging by pressing two corners in a second diagonal direction different from the first diagonal direction, and performing a secondary come-back forging of the second forging step, and after performing the second come-back forging of the second forging step, a step of performing a tertiary wedge forging by pressing corners in a third diagonal direction different from the first and the second diagonal directions and performing a tertiary come-back forging of the second forging step, wherein surfaces to be pressed in each of the primary, the second, and the tertiary upset forgings, and the primary, the second, and the tertiary come-back forgings of the second forging step are different from each other, wherein corners to be pressed in each of the primary, the second, and the tertiary wedge forgings, and the primary, the second and the tertiary come-back forgings of the second forging step are different from each other, wherein two corners to be pressed into two surfaces are deformed in the primary wedge forming, and another two corners to be pressed into another two surfaces are deformed in the come-back forging of the second forging step, so that a direction of the tantalum billet is rotated by performing one of the wedge forging and the come-back forging of the second forging step.

2. The method of claim 1, wherein the upset forging is performed by restricting a deformation of the tantalum billet in a direction (X) based on directions (X, Y, Z) which are perpendicular to each other, and pressing a surface of the tantalum billet along the direction (Z) in a state where a deformation rate in the direction (Y) is set.

3. The method of claim 2, wherein the upset forging is performed in a first base mold and a first pressing mold, and the first base mold comprises:

deformation restricting surfaces brought into contact with surfaces of the tantalum billet facing the direction (X) so as to restrict the plastic deformation of the tantalum billet in the direction (X); and deformation rate setting surfaces spaced apart from surfaces of the tantalum billet facing the direction (Y) so as to set the deformation rate of the tantalum billet, and the first pressing mold is composed so as to press the surface of the tantalum billet facing the direction (Z).

4. The method of claim 1, wherein the come-back forging of the first forging step is performed by restricting a deformation of the tantalum billet in a direction (X) based on directions (X, Y, Z) which are perpendicular to each other, and pressing a surface of the tantalum billet along the direction (Y) in a state where a deformation rate in the direction (Z) is set.

5. The method of claim 4, wherein the come-back forging of the first forging step is performed in a second base mold and a second pressing mold, and the second base mold comprises:

deformation restricting surfaces of the second base mold brought into contact with surfaces of the tantalum billet facing the direction (X) so as to restrict the plastic deformation of the tantalum billet in the direction (X);

deformation rate setting surfaces of the second base mold spaced apart from surfaces of the tantalum billet facing the direction (Z) so as to set the deformation rate of the tantalum billet; and a bottom surface which forms a receiving portion corresponding to the original shape of the tantalum billet together with the deformation restricting surfaces and the deformation rate setting surfaces, and the second pressing mold is composed so as to press one surface of the tantalum billet facing the direction (Y).

6. The method of claim 1, wherein the wedge forming is performed by restricting a deformation of the tantalum billet in one direction, and pressing, in a state where a deformation rate is set in a direction which makes two corners located in a direction diagonal to each other among four corners parallel to the one direction in which the deformation is restricted, spaced apart from each other, the other two corners in a direction which makes the other two corners to be pressed to each other.

7. The method of claim 6, wherein the wedge forging deforms two corners spaced apart from each other so as to plastically deform the tantalum billet into an octahedron.

8. The method of claim 6, wherein the wedge forging is performed in a third base mold and a third pressing mold, and the third base mold comprises:

deformation restricting surfaces brought into contact with surfaces of the tantalum billet facing one direction so as to restrict a plastic deformation of the tantalum billet in the one direction;

a first pressing corner composed so as to support a corner of the tantalum billet;

first pressing inclined surfaces formed to be inclined symmetrically at both sides of the first pressing corner so as to set a deformation rate of the tantalum billet; and height surfaces spaced apart from the tantalum billet so as to deform the tantalum billet into an octahedron, and the third pressing mold comprises:

a second pressing corner composed so as to press a corner located in a diagonal direction of a corner supported by the first pressing corner; and second pressing inclined surfaces formed to be inclined symmetrically at both sides of the second pressing corner so as to set a deformation rate of the tantalum billet.

9. The method of claim 8, wherein an angle between the first pressing inclined surfaces and an angle between the second pressing inclined surfaces are each 100° to 170°.

10. The method of claim 7, wherein the come-back forging of the second forging step is performed by restricting a deformation of the tantalum billet in the one direction, and pressing a surface formed by the wedge forging in a state where a deformation rate is set in a direction which again makes the two corners to be pressed to each other and the two corners are by the wedge forging far away from each other.

11. The method of claim 10, wherein the come-back forging of the second step deforms two surfaces located at both sides of each of the two surfaces which are again far away from each other into one surface so as to plastically deform the tantalum billet into a hexahedron.

12. The method of claim 10, wherein the come-back forging of the second forging step is performed in a fourth base mold and a fourth pressing mold, and the fourth base mold comprises:

deformation restricting surfaces brought into contact with surfaces of the tantalum billet facing the one direction so as to restrict the plastic deformation of the tantalum billet in the one direction;

deformation rate setting surfaces spaced apart from the corners pressed during the wedge forging so as to deform the tantalum billet into a hexagon; and a bottom surface which forms a receiving portion corresponding to the original shape of the tantalum billet together with the deformation restricting surfaces and the deformation rate setting surfaces, and the fourth pressing mold is composed so as to press a surface formed by the wedge forging.

13. The method of claim 1, wherein in the step of performing the cold rolling multiple times, a total reduction ratio applied to the tantalum billet is set at 50% to 99%, such that the tantalum billet has a crystal size of 50 μm or less.

14. The method of claim 1, wherein in the step of performing the cold rolling multiple times, after a primary cold rolling is performed so as to change the rolling direction, the tantalum billet is rotated, and then a rolling is performed.

15. The method of claim 14, wherein in the step of performing the cold rolling multiple times, the rotation angles of the tantalum billet are the same as each other every time.

16. The method of claim 14, wherein in the step of performing the cold rolling multiple times, the rotation angle of the tantalum billet every time is set within a range from 5° to 535°.

17. The method of claim 14, wherein the step of performing the cold rolling multiple times is carried out so as to reach a total reduction ratio set as a goal, when a product of a rotation angle (a°) of the tantalum billet every time and the number (r) of cold rollings performed coincides with a multiple number (N, N is a natural number) of 360(°) ($a° \times r = 360° \times N$).

18. The method of claim 1, wherein a recrystallization heat treatment is further performed at 800° C. to 1,400° C. for 1 minute to 5 hours after the step of performing the cold working.

19. The method of claim 18, wherein the crystal size of the tantalum billet is controlled to 100 μm or less by performing the recrystallization heat treatment, and an orientation distribution function and a development intensity of a pole intensity of the tantalum billet are controlled so as to have a texture distribution of 3 or less.

20. The method of claim 1, wherein a uniaxial cold forging is performed on the tantalum billet to have a thickness decrease rate of 40% or more after the step of performing the cold working, and subsequently, a selective heat treatment is further performed at 800° C. to 1,400° C. for 1 minute to 5 hours.

21. The method of claim 1, wherein a recrystallization heat treatment is further performed at 800° C. to 1,400° C. for 1 minute to 5 hours after the step of performing the cold rolling.

22. The method of claim 21, wherein the tantalum billet is processed into a tantalum plate having a plate surface by performing the cold rolling, the crystal size of the tantalum plate is controlled to 50 μm or less by performing the crystallization heat treatment, and a texture of the tantalum plate is controlled such that at least one crystal plane of {111}, {100}, and {110} is oriented parallel to the plate surface.

23. The method of claim 1, wherein in the step of performing the cold working, a stress relief heat treatment is performed after the first forging step or the second forging step, and the stress relief heat treatment is performed at about 800° C. to about 1,400° C. for about 1 minute to about 5 hours.

* * * * *